US009687032B2

(12) United States Patent
McBride et al.

(10) Patent No.: US 9,687,032 B2
(45) Date of Patent: Jun. 27, 2017

(54) SURGICAL GOWN AND METHOD OF MANUFACTURING THE SURGICAL GOWN

(75) Inventors: Mark Tabin McBride, Coronado, CA (US); Phong Duy Bui, San Diego, CA (US); Joseph John Jankiewicz, Coronado, CA (US); Ruel Flores Salvador, San Diego, CA (US)

(73) Assignee: Operating Room Innovations, Inc, Coronado, CA (US)

( * ) Notice: Subject to any disclaimer, the term of this patent is extended or adjusted under 35 U.S.C. 154(b) by 144 days.

(21) Appl. No.: 13/489,339

(22) Filed: Jun. 5, 2012

(65) Prior Publication Data

US 2013/0318693 A1 Dec. 5, 2013

(51) Int. Cl.
*A41D 13/12* (2006.01)

(52) U.S. Cl.
CPC ..... *A41D 13/1209* (2013.01)

(58) Field of Classification Search
CPC .. A41D 13/02; A41D 13/001; A41D 13/0002; A41D 13/015; A41D 13/1209; A41D 13/1218; A41D 27/28; A41D 13/0007; A41D 13/008; A41D 13/018; A41D 13/05; A41D 2600/102; A41D 31/0016; A41D 31/0061; A41D 31/02; A41D 31/0038; A41D 13/0015; A41D 1/06; A41D 13/0017; A41D 13/0512; A41D 13/08; A41D 13/11; A41D 13/1169; A41D 19/0017; A41D 1/00; A41D 2300/32; A41D 2400/38; A41D 2400/46; A41D 3/00; A41D 13/0012; A41D 13/0155; A41D 13/065; A41D 1/002; A41D 13/0525; A41D 1/04; A41D 1/084; A41D 2400/20; A41D 2600/108
USPC ..... 2/51, 114, 83, 456
See application file for complete search history.

(56) References Cited

U.S. PATENT DOCUMENTS

| | | | | |
|---|---|---|---|---|
| 3,359,569 | A * | 12/1967 | Scrivens et al. | 2/114 |
| 3,570,102 | A | 3/1971 | Winters | |
| 3,594,818 | A * | 7/1971 | Planner | 2/114 |
| 3,754,284 | A * | 8/1973 | Hartigan et al. | 2/114 |

(Continued)

FOREIGN PATENT DOCUMENTS

| | | |
|---|---|---|
| EP | 1695638 | 8/2006 |
| JP | 2003-031834 | 8/2004 |
| WO | WO94/12065 | 6/1994 |

*Primary Examiner* — Anna Kinsaul
*Assistant Examiner* — Catherine M Ferreira
(74) *Attorney, Agent, or Firm* — Jerry R. Potts; James R. McDaniel

(57) ABSTRACT

Surgical gown and method of manufacturing the surgical gown. In a first embodiment, the surgical gown requires only one operating room person to assist a surgeon in donning the gown. A shoulder flap extends from a rear torso portion, over a shoulder portion and to a front torso portion of the gown. With assistance of only one other person, the surgeon rotates to enclose himself within the surgical gown, secure the flap to the front of the gown and tie waist tie strings. A second embodiment gown is self-donning. The second embodiment comprises a pole to which the flap and one waist tie string are removably attached. The surgeon rotates to enclose himself within the gown, removes the flap and waist tie string from the pole, attaches the flap to the gown and ties the waist tie strings to complete the gowning procedure.

33 Claims, 32 Drawing Sheets

(56) References Cited

U.S. PATENT DOCUMENTS

| | | | | | |
|---|---|---|---|---|---|
| 3,935,596 | A | * | 2/1976 | Allen, Jr. | A41D 13/1209 2/114 |
| 4,000,521 | A | | 1/1977 | Zoephel et al. | |
| 4,214,320 | A | | 7/1980 | Belkin | |
| 4,255,818 | A | * | 3/1981 | Crowley | A41D 13/1209 2/114 |
| 4,369,527 | A | * | 1/1983 | Paul | 2/51 |
| 4,371,986 | A | * | 2/1983 | Wichman | 2/51 |
| 4,373,214 | A | * | 2/1983 | Wichman | 2/51 |
| 4,395,782 | A | * | 8/1983 | Reynolds | 2/114 |
| 4,451,931 | A | * | 6/1984 | Wichman | 2/51 |
| 4,457,024 | A | * | 7/1984 | Wichman | 2/51 |
| 4,504,978 | A | * | 3/1985 | Gregory, Jr. | A41D 13/1227 2/114 |
| 4,558,468 | A | * | 12/1985 | Landry | A41D 13/1209 2/114 |
| 4,587,671 | A | * | 5/1986 | Rodriguez et al. | 2/69 |
| 4,631,756 | A | | 12/1986 | Scrivens | |
| 4,674,132 | A | * | 6/1987 | Stein et al. | 2/114 |
| 4,982,448 | A | | 1/1991 | Kogut | |
| 5,033,115 | A | * | 7/1991 | Bowling | A41D 13/11 2/48 |
| 5,083,315 | A | | 1/1992 | Dillon, Jr. | |
| 5,414,867 | A | * | 5/1995 | Bowling et al. | 2/51 |
| 6,049,907 | A | * | 4/2000 | Palomo | 2/51 |
| 6,115,839 | A | | 9/2000 | Covington et al. | |
| 6,138,278 | A | * | 10/2000 | Taylor et al. | 2/114 |
| 6,948,187 | B2 | * | 9/2005 | Drake | 2/51 |
| 7,549,179 | B1 | | 6/2009 | Saied | |
| 2005/0132465 | A1 | | 6/2005 | Kathumbi-Jackson et al. | |

* cited by examiner

SURGICAL GOWN AND METHOD OF MANUFACTURING THE SURGICAL GOWN

FIELD OF THE INVENTION

This invention generally relates to body garments and more particularly relates to a surgical gown requiring only one person to assist a surgeon, or optionally not requiring anyone to assist the surgeon, in donning the surgical gown and a method of manufacturing the surgical gown.

BACKGROUND OF THE INVENTION

During a surgical procedure, there is a need to provide an effective barrier to protect a surgery patient and operating room personnel from transfer of microorganisms, body fluids and particulates that might otherwise cause infections. For example, infectious microorganisms may include Methicillin-Resistant *Staphylococcus Aureus* (MRSA), which is a bacterium that can lead to skin infections causing redness, swelling, tenderness of the skin and also possibly causing boils, blisters, pustules, and abscesses on the skin. In addition, a body fluid, such as blood, might contain blood-borne pathogens, such as Human Immunodeficiency Virus (HIV) that can lead to impairment of the human immune system. Moreover, Hepatitis B and C viruses are also blood-borne pathogens. The Hepatitis B and C viruses can damage the liver. Particulates, on the other hand, may be dried residue from disinfectants or chemicals. The particulates can migrate into the surgical wound and cause infection or the particulate matter can even, at least partially, clog a catheter tube during the surgical procedure.

Prior to surgery, a surgeon dons the surgical gown to provide the previously mentioned safe and effective barrier to protect the patient and the surgeon from transfer of microorganisms, body fluids and particulates that might otherwise cause infections. However, a conventional surgical gown design typically requires two people to assist the surgeon in donning the surgical gown. The two people are a sterile surgical or "scrub nurse" and a non-sterile "circulating nurse." The sterile scrub nurse assists the surgeon during the surgical procedure and is allowed within a defined sterile surgical field during the operation. The surgical field is an isolated area in the operating room where surgery is performed and that must be kept sterile at all times using known aseptic techniques. The circulating nurse is an individual who has not scrubbed-in with other members of the surgical team. However, the circulating nurse coordinates, plans and implements other nurse-related duties associated with the surgery. The non-sterile circulating nurse remains at all times outside the sterile surgical field prior to and during the surgical procedure. As mentioned, a conventional surgical gown requires both the scrub nurse and the circulating nurse to assist the surgeon in donning the surgical gown. In this regard, about 11 procedural steps are required in order for the surgeon to don the conventional surgical gown with the assistance of the scrub nurse and the circulating nurse.

The typical two-assistant procedure for donning the conventional surgical gown begins by the scrub nurse assisting the surgeon in placing the surgeon's arms inside the gown's sleeves. The scrub nurse then begins the process of assisting the surgeon in draping the gown over the surgeon's shoulders and front torso. Neither the surgeon nor the scrub nurse touches the outside of the gown, so that sterility of the outside of the gown is maintained. The scrub nurse also assists the surgeon in gloving. That is, the scrub nurse assists the surgeon in pulling sterile surgical gloves over the surgeon's hands according to a predetermined gloving procedure.

As the gown is being draped over the surgeon's shoulders and front torso, the non-sterile circulating nurse, who is standing outside the sterile surgical field and behind the surgeon, assists in the gown donning process by pulling the gown toward and around the back of the surgeon. The circulating nurse then ties and knots a plurality of relatively small strings distributed along two longitudinally opposing edges of the open back portion of the gown. However, there may remain an exposed longitudinal gap separating the two longitudinally opposing edges of the open back portion of the gown. This longitudinal gap may exist even after the circulating nurse has tied and knotted the strings distributed along the two longitudinally opposing edges of the open back portion of the gown. The circulating nurse may also secure the collar of the gown about the neck of the surgeon by closing fasteners (e.g., strings, VELCRO® brand fasteners, or other fasteners) located at the rear neck portion of the gown. VELCRO® is a registered trademark of Velcro Industries, B.V. located in Amsterdam, The Netherlands. As previously mentioned, the circulating nurse never touches the outside of the gown in order to maintain sterility of the gown. Therefore, the circulating nurse will not touch the outside of the collar as the circulating nurse secures the collar of the gown about the neck of the surgeon.

A disadvantage associated with this procedure is that a conventional gown often inadvertently opens-up along the gap at the back of the gown either due to movement of the surgeon or due to inappropriately sized gowns having to fit larger surgeons. Presence of the gap is undesirable because the gap may expose the inside of the gown to the surgical field. As previously mentioned, the inside of the gown is considered non-sterile. Therefore, the surgeon will necessarily limit his movements during the surgical procedure, such that the open gap never faces the patient during the surgical procedure. This limitation on movement necessarily restricts mobility of the surgeon during the surgical procedure. In addition, the non-sterile gap portion of the surgeon's gown may contact the sterile front portion of a gown being worn by an assistant who may be standing adjacent to the surgeon. If this occurs, the assistant's gown is considered contaminated and must be discarded.

Next, after the neck area is secured, the gown is draped on the surgeon, the rear strings tied and knotted, the surgeon breaks a "transfer card" into two portions. The transfer card releasably holds two free ends of a pair of waist strings that have fixed ends attached to the gown. After breaking the transfer card, one portion of the transfer card is given to the scrub nurse and the other portion is retained by the surgeon. Thereafter, the surgeon rotates 360 degrees while holding his portion of the transfer card that has one free end of its waist string attached thereto. As the surgeon rotates, the scrub nurse holds her portion of the transfer card that has the other free end of its waist string attached to the transfer card.

After the surgeon makes the complete 360 degree rotation, the surgeon retrieves the portion of the transfer card being held by the scrub nurse. The surgeon retrieves this portion of the transfer card from the scrub nurse without touching the scrub nurse in order to maintain sterility of the surgical gown. The surgeon touches only the transfer card as the surgeon retrieves the transfer card from the scrub nurse. At that point, the surgeon is in possession of both portions of the transfer card.

Next, the surgeon releases both free ends of the waist strings from their respective portions of the transfer card.

The two portions of the transfer card are then discarded by being dropped to the floor. Next, the surgeon ties both free ends of the waist strings together about his waist.

The donning procedure is complete after the surgeon ties the two free ends of the waist strings together about his waist. In any event, surgical gowns are either of two basic types. In this regard, surgical gowns can be disposable (i.e., single-use) gowns made of non-woven material, such as a spread tow plastic film composite. Surgical gowns can also be reusable gowns made of woven cotton or woven synthetic material. Regardless of gown design, surgical gown designs marketed in interstate commerce are submitted to and cleared by the U.S. Food and Drug Administration as "501(k) premarket submissions" under 21 Code of Federal Regulations, Part 807.

Various means are used for manufacturing conventional disposable and reusable surgical gowns. Disposable surgical gowns can be made of non-woven material, such as a spread tow plastic film composite, as mentioned hereinabove. Reusable surgical gowns can be made of woven cotton or woven synthetic material, such as fine endless polyester fibers or various combinations of materials. Also, reusable surgical gowns may be laminated with layers of plastic film in combination with the cotton or synthetic material in order to prevent strike-through of liquids. In either case of disposable or reusable surgical gowns, the surgical gown material is selected so that the surgical gown is resistant to abrasion and tearing and so that the surgical gown releases practically no particulates.

Surgical gowns having dimensions for a particular size and style are cut from bales of the materials mentioned hereinabove. Seams are typically either sewn or ultrasonically bonded. The surgical gown is also sterilized to kill microorganisms before the surgical gown is properly folded, vacuum packaged and shipped to a medical facility, such as a hospital. Sterilization techniques include heat applied in an autoclave using either dry or wet heat. Alternatively, the sterilization technique may use ethylene oxide gas. Radiation also may be used as a sterilizing technique during the manufacturing process.

However, use of conventional surgical gowns obtains several disadvantages. In this regard, and as mentioned hereinabove, one disadvantage is some conventional surgical gown designs require two people to assist the surgeon in donning the surgical gown. The two persons are the circulating nurse and the scrub nurse. Inclusion of the circulating nurse in the donning procedure reduces the amount of time the circulating nurse has available to attend to her other duties, such as coordinating, planning and implementing nurse-related duties associated with the surgical procedure. Reducing the amount of time the circulating nurse has available to attend to her other duties decreases productivity and efficiency of the circulating nurse and therefore increases operating costs for the medical facility employing the circulating nurse.

Another disadvantage of some conventional gown designs is some conventional surgical gown designs do not provide for 360 degree sterility. With respect to conventional surgical gowns, the gap mentioned hereinabove may exist between the two longitudinally opposing edges of the open back portion of the gown. As previously mentioned, this gap may exist even after the circulating nurse ties and knots the plurality of strings distributed along the two longitudinally opposing edges of the open back portion of the gown. The gap necessarily increases the risk of exposing the non-sterile inside of the gown to the sterile surgical field. Therefore, some conventional gown designs have less than 360 degree sterility due to presence of the gap. This disadvantage associated with using some conventional gown designs having a gap in the rear thereof may limit mobility of the surgeon during the surgical procedure and may increase risk of contaminating gowns being worn by nearby surgical personnel, as mentioned hereinabove.

Yet another disadvantage associated with use of some conventional surgical gown designs is that the donning procedure is time consuming. For example, the circulating nurse must tie and knot a plurality of relatively small strings distributed along the two longitudinally opposing edges of the open back portion of the gown. The time used to tie and knot these strings increases the time to complete the surgical procedure and may increase the amount of time the patient is under anesthesia, which is undesirable.

Various approaches have been attempted to address the disadvantages mentioned hereinabove. For example, U.S. Pat. No. 4,214,320 titled "Surgical Gown and Method of Donning Gown" and issued Jul. 29, 1980 in the name of Nathan L. Belkin discloses a surgical gown that includes three arm holes, two of which have long covered sleeves. The third arm hole is a large opening in an extended side panel having a shoulder band along one edge to permit the length of the upper arm between the shoulder and elbow to pass through the large opening. A pull tab or donning tab is secured to the band, and is intended to be manipulated by an assistant during the donning of the gown. In the closed position, the extended panel completely covers the back and overlaps the other side and a front portion of the gown, with the band secured around the shoulder and sleeve. According to this patent, the sterile surgical gown is donned by completely wrapping it around the wearer to provide a secure enclosure which requires no fasteners or ties. An assistant holds the donning tab to guide the extended side panel and band off the sleeved arm extending through the third arm hole; then around the back of the wearer and over the sleeved arm. However, it would appear there is a risk that the surgical gown might inadvertently open due to movement of the surgeon during the surgical procedure because the gown does not use fasteners or ties.

Another approach is disclosed in U.S. Pat. No. 4,982,448 titled "Surgical Gown with Transfer Card" and issued Jan. 8, 1991 in the name of Walter Kogut. This patent discloses that, in a surgical gown belted by tie-strings, one of the tie-strings has one end secured to the gown and the other end releasably attached to a transfer card. Means is provided for adhesively, but releasably, securing the transfer card to the front of the gown. The second tie-string has one end secured to the gown and is temporarily tucked into and supported by a loop sewn or otherwise attached on the front of the gown. After the gown has been donned and the tie-strings have been tied together, the transfer card is thrown away. However, this patent does not appear to require both tie-strings to be releasably attached to the transfer card. Rather, the second tie-string is merely tucked into and supported by the loop sewn or otherwise attached on the front of the gown. Therefore, it would appear that the second tie-string may become inadvertently dislodged from the loop by movement of the surgeon or surgeon's assistant during gowning. Inadvertently dislodging the second tie-string from the loop may increase the risk that at least a portion of the second tie-string will freely and uncontrollably hang from the gown and become contaminated.

Yet another approach is disclosed in U.S. Pat. No. 7,549,179 B1 titled "Self-Donning Surgical Gown" and issued Jun. 23, 2009 in the name of Amgad Samuel Saied. This patent discloses a self-donning surgical gown comprising a plurality of pockets positioned strategically along the shoulders and back to allow the user to insert his hands into the shoulder and waist pockets to secure the surgical gown to his shoulders and back, respectively, without exposing his hands and arms to the non-sterile environment outside the traditional sterile field, thereby effectively increasing the sterile field and allowing the user to self-don the surgical gown. The pockets and/or the back flaps of the surgical gown may comprise fasteners, such as adhesives, hook-and-loop fasteners, ties, magnets, buttons or the like to fasten the self-donning surgical gown to itself or to a garment normally worn by the user. However, this patent appears to require a complicated procedure or extensive series of steps for placement of the wearer's hands into the plurality of pockets on the gown. Also, it appears that the procedure for placement of the wearer's hands into the plurality of pockets must be in a prescribed and precise order, so that the gown can be properly donned. Such a complicated procedure might be problematic during the rush of an emergency surgical procedure unless the surgeon is thoroughly familiar with the series of steps, and precise order of steps, required to don the gown. It would appear that substantial and time consuming training and retraining for a surgeon is required beforehand, so that the surgeon can properly and effortlessly use the gown during a surgical procedure. Time spent to perform such extensive training and retraining may increase operating costs for the medical facility.

An improved gown assembly technique, the use thereof providing improved barrier protection and material utilization, is disclosed in U.S. Pat. No. 6,115,839 titled "Surgical Gown and Method for Making the Same" and issued Sep. 12, 2000 in the names of David Loring Covington, et al. This patent discloses a surgical gown that includes opposed back panels having non-parallel side edges which define a slit. When the gown is in use, portions of the opposed back panels overlap along substantially the entire length of the slit. Ties are provided on the back panels for fastening the back panels together. Thus, the slit is covered and no gap in present between the opposed back panels. However, it would nonetheless appear that the gown is assembled to allow for back panels that are tied together. Tying of such back panels may be a time consuming process and inadvertent untying of the ties may expose portions of the non-sterile interior of the gown to the surrounding sterile surgical field. Exposure of the non-sterile interior of the gown to the surrounding sterile surgical field may result in contaminating the surgical field.

Although the prior art approaches recited hereinabove may disclose various surgical gown designs for use during a surgical procedure, the prior art recited hereinabove do not appear to disclose the surgical gown invention described and claimed hereinbelow.

SUMMARY OF THE INVENTION

The present invention addresses the shortcomings of the prior art approaches mentioned hereinabove by providing a surgical gown and method of manufacturing the surgical gown. The surgical gown of the present invention requires only a scrub nurse to assist the surgeon, or optionally not requiring anyone to assist the surgeon, during the gowning procedure. Elimination of the circulating nurse and/or the scrub nurse from the gowning procedure allows the circulating nurse and/or scrub nurse to be available for attending to other duties associated with the surgical procedure, thereby increasing their productivity and efficiency which in turn reduces operating costs for the medical facility employing the circulating nurse and scrub nurse.

In addition, the surgical gown of the present invention provides for 360 degree sterility. In this regard, the previously mentioned gap that would otherwise exist in the rear or back portion of the conventional gown is eliminated in a manner such that the gap cannot reopen due to movement of the surgeon or due to undoing of ties. Providing 360 degree sterility increases surgeon mobility, increases or at least maintains sterility and reduces risk of infection to the patient and to the surgeon. Providing 360 degree sterility also reduces risk of contaminating gowns being worn by nearby surgical personnel.

Further, donning the surgical gown of the present invention is less time-consuming compared to some conventional gown designs. When using the surgical gown of the present invention, there is no need to tie and knot a plurality of relatively small tie strings distributed along opposing edges of an open back portion of the surgical gown because there is no open back portion of the surgical gown. Moreover, the surgical gown of the present invention requires fewer steps to don the surgical gown compared to greater number of steps required by some conventional surgical gown designs. Using fewer steps saves time and, therefore, increases productivity and efficiency of the surgical procedure. Increasing productivity and efficiency of the surgical procedure reduces operating costs for the medical facility where the surgical procedure is being performed.

In one embodiment, the surgical gown has (1) a portion thereof laterally extended on the back right of the gown from the top to the bottom of the gown; (2) an upper shoulder flap with a hook-and-loop (e.g., a VELCRO® brand fastener) shoulder flap fastener tab or other type of fastener; and (3) a pair of waist tie strings, each having a fixed end attached to the gown and a free end releasably attached to a quick-release transfer card. Once the gown is draped upon the surgeon, the surgeon passes the quick-release transfer card to the scrub nurse. The scrub nurse then breaks and separates the quick-release transfer card into two portions. Each portion of the quick-release transfer card has the respective free end of one of the waist tie strings releasably attached to it. The scrub nurse passes one of the portions of the quick-release transfer card to the surgeon and retains the other portion. Separating the quick-release transfer card into two portions in this manner is needed in order to allow the surgeon to rotate 360 degrees counterclockwise. As the surgeon rotates counterclockwise 360 degrees, a shoulder flap tab belonging to a shoulder flap that is part of the gown is grasped by the scrub nurse who extends the shoulder flap over a shoulder of the surgeon. The surgeon grabs the hook-and-loop (e.g., VELCRO® brand fastener) shoulder flap tab and engages the hook-and-loop shoulder flap tab with a hook-and-loop fastener that is attached to the front left of the gown. In this manner, the shoulder flap tab is releasably secured to the front left of the gown and the shoulder flap is secured about the neck of the surgeon without assistance of the circulating nurse. Also, as previously mentioned, the shoulder flap is completely and sterilely secured about the neck of the surgeon, thereby eliminating a need for the circulating nurse to tie or otherwise fasten the gown about the neck of the surgeon.

At this point, and after the surgeon has rotated 360 degrees, the other portion of the quick-release transfer card being held by the scrub nurse is handed to the surgeon, so that the surgeon can secure a lower extended part of the gown to the front waist area of the gown. Therefore, the lower extended part of the gown now covers the back of the surgeon. This eliminates the need for the circulating nurse to tie strings in the back of the gown. The surgeon separates the free ends of the pair of waist tie strings from their respective portions of the quick-release transfer card and ties the waist tie string stings together. At this point, the donning procedure is complete and the surgeon may proceed with surgery.

In another embodiment, the gown may be self-donned by the surgeon. In the self-donning embodiment, neither the circulating nurse nor the scrub nurse is required to assist the surgeon with gowning. To achieve this result, an upright structure, stand or pole has two spaced-apart supports connected to it. An uppermost support is adapted to grip or otherwise secure the shoulder flap while a lowermost support is adapted to grip or otherwise secure one portion of the broken quick-release transfer card to which a free end of one of the waist tie strings is releasably attached. After the surgeon secures the shoulder flap to the uppermost support and the portion of the quick-release transfer card to the lowermost support, the surgeon rotates 360 degrees counterclockwise. As the surgeon rotates 360 degrees counterclockwise, he holds the other portion of the quick-release transfer card to which the free end of the other waist tie string is releasably attached. After the surgeon completes the 360 degree rotation, he retrieves the portion of the shoulder flap held by the uppermost support and attaches the shoulder flap to the front of the gown, such as by means of hook-and-loop fasteners. The surgeon then retrieves the portion of the quick-release transfer card held by the lowermost support. Next, the surgeon releases the two free ends of the waist tie strings from their respective portions of the quick-release transfer card and proceeds to tie the waist tie strings together. The donning procedure is complete, once the waist tie strings are tied together.

According to an aspect of the present invention, there is provided a surgical gown, comprising: a panel having a front torso portion, a shoulder portion, and a rear torso portion; a flap having a first end attached to the rear torso portion and a second end placeable at the front torso portion, the flap being extendable from the rear torso portion to the front torso portion; a first fastener attached to the front torso portion; and a second fastener attached to the second end of the flap, the second fastener being adapted to engage the first fastener for fastening the second end of the flap to the front torso portion.

According to another aspect of the present invention, there is provided a surgical gown, comprising: a panel adapted to surround a torso of a wearer, the panel having a front torso portion having an interior surface, a shoulder portion contiguous with the front torso portion and a rear torso portion contiguous with the front torso portion and the shoulder portion; an elongate shoulder flap having a first end attached to the rear torso portion of the panel and a second end placeable at the front torso portion of the panel, the shoulder flap being extendable from the rear torso portion of the panel, over the shoulder portion and to the front torso portion of the panel; a first fastener attached to the front torso portion of the panel; a second fastener attached to the second end of the shoulder flap and engageable with the first fastener for fastening the second-end of the shoulder flap to the front torso portion of the panel; a protective liner attached to the interior surface of the front torso portion of the panel for protecting the wearer from bacterial or optionally viral infection; and a first waist tie string having a first end attached to the front torso portion of the panel and having a first free end, a second waist tie string having a second end attached to the rear torso portion of the panel and having a second free end, the second waist tie string being of sufficient length to extend substantially around the torso of the wearer to the front torso portion of the panel so as to allow tying of the second free end of the second waist tie string to the first free end of the first waist tie string, whereby the rear torso portion of the panel is releasably secured to and substantially overlaps the front torso portion of the panel while the first free end of the first waist tie string is tied to the second free end of the second waist tie string and whereby the panel substantially envelops the wearer while the first free end of the first waist tie string is tied to the second free end of the second waist tie string.

According to yet another aspect of the present invention, there is provided a surgical gown, comprising: a fabric panel for draping a surgical operating room person, the fabric panel having a front torso portion with a pair of spaced apart elongate sleeve members, the fabric panel having a shoulder portion contiguous with and extending away from the pair of spaced apart elongate sleeve members at about their proximal ends a sufficient distance to drape over a shoulder of the surgical operating room person, the fabric panel having a wrap around rear torso portion for extending about one side of a mid area of the front torso portion a sufficient distance to wrap around and completely drape an upper rear torso area of the surgical operating room person, the wrap around rear torso portion terminating at its distal end at about an opposite side of the mid area of the front torso portion, and the wrap around rear torso portion having a shoulder flap for extending over the shoulder portion at about the opposite side of the mid area of the front torso portion, the shoulder flap being adapted to be releasably secured to an area at about the opposite side of the mid area of the front torso portion.

According to a further aspect of the present invention, there is provided a surgical gown, comprising: a panel having a front torso portion, a shoulder portion, and a rear torso portion; a flap having a first end attached to the rear torso portion and a second end placeable at the front torso portion, the flap being extendable from the rear torso portion to the front torso portion; a first fastener attached to the front torso portion; a second fastener attached to the second end of the flap, the second fastener being adapted to engage the first fastener for fastening the second end of the flap to the front torso portion; a quick-release transfer card associated with the panel; a waist tie string having a free end thereof releasably attached to the quick-release transfer card; and an upright structure having an uppermost support adapted to hold the second end of the flap and having a lowermost support adapted to hold the quick-release transfer card, the uppermost support and the lowermost support being arranged to cooperatively assist a wearer of the surgical gown to self-don the surgical gown.

According to still another aspect of the present invention, there is provided a method of manufacturing a surgical gown, comprising: providing a fabric blank; cutting the fabric blank to form a panel having a front torso portion, a shoulder portion, a rear torso portion and a shoulder flap, the shoulder flap having a first end integrally attached to the rear torso portion of the panel, the shoulder flap being extendable over the shoulder portion and having a second end placeable at the front torso portion of the panel; attaching a first fastener to the front torso portion of the panel; and attaching a second fastener to the second end of the shoulder flap, the second fastener being adapted to engage the first fastener.

A feature of the present invention is the provision of a fabric panel having a shoulder flap extending a sufficient distance to drape over a shoulder of a surgical operating room person and secured providing a neck tight fit.

Another feature of the present invention is the provision of a fabric panel having a wrap around rear torso portion for extending about one side of a mid area of a front torso portion a sufficient distance to wrap around and completely drape an upper rear torso area of the surgical operating room person, the wrap around rear torso portion terminating at its distal end at about an opposite side of the mid area of the front torso portion, the wrap around rear torso portion having a shoulder flap for extending over the shoulder portion at about the opposite side of the mid area of the front torso portion, the shoulder flap being adapted to be releasably secured to an area at about the opposite side of the mid area of the front torso portion thereby providing the wearer with a neck tight fit.

An additional feature of the present invention is the provision of a quick-release transfer card temporarily connected to free ends of respective ones of a pair of waist tie strings for releasably connecting the free ends of the pair of waist tie strings together.

In addition to the foregoing, various other method and/or device aspects and features are set forth and described in the teachings, such as text (e.g., claims and/or detailed description) and/or drawings of the present invention.

The foregoing is a summary and thus, may contain simplifications, generalizations, inclusions, and/or omissions of detail. Consequently, those skilled in the art will appreciate that the summary is illustrative only and is not intended to be in any way limiting. In addition to the illustrative aspects, embodiments, and features described hereinabove, further aspects, embodiments, and features will become apparent by reference to the drawings and the following detailed description.

BRIEF DESCRIPTION OF THE DRAWINGS

The invention will be more fully understood by reference to the detailed description in conjunction with the following figures, wherein.

DETAILED DESCRIPTION OF PREFERRED EMBODIMENTS

Figure 1:
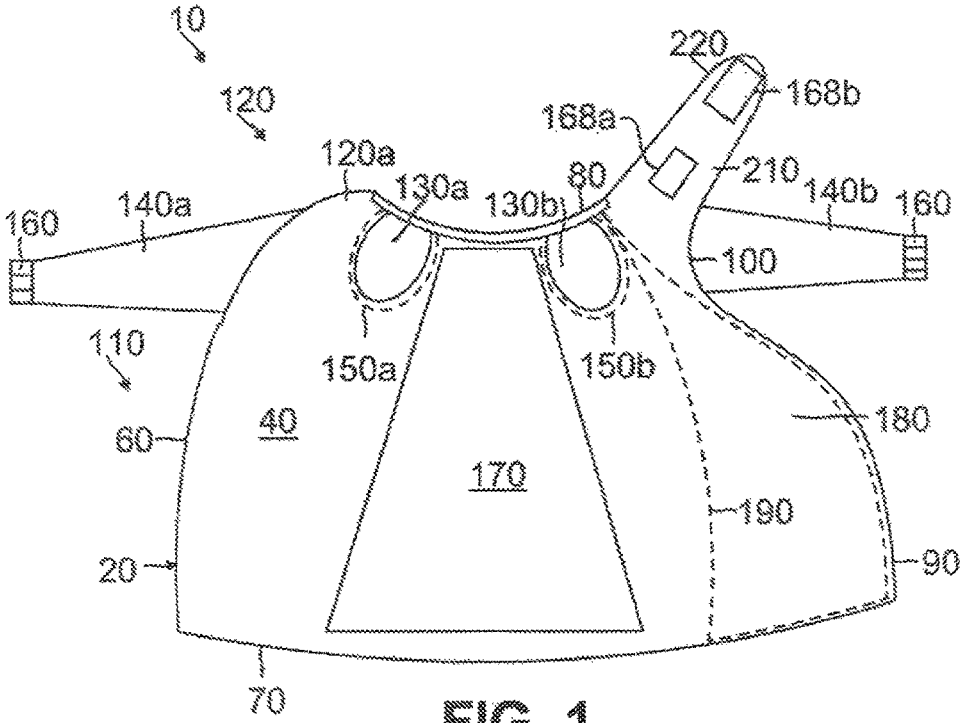
FIG. 1 is a view in elevation of an interior of a first embodiment surgical gown, the first embodiment surgical gown comprising a panel having a front torso portion for draping a front torso of a wearer thereof, a rear torso portion for draping a rear torso of a wearer thereof, a shoulder portion and a shoulder flap.
Figure 2:
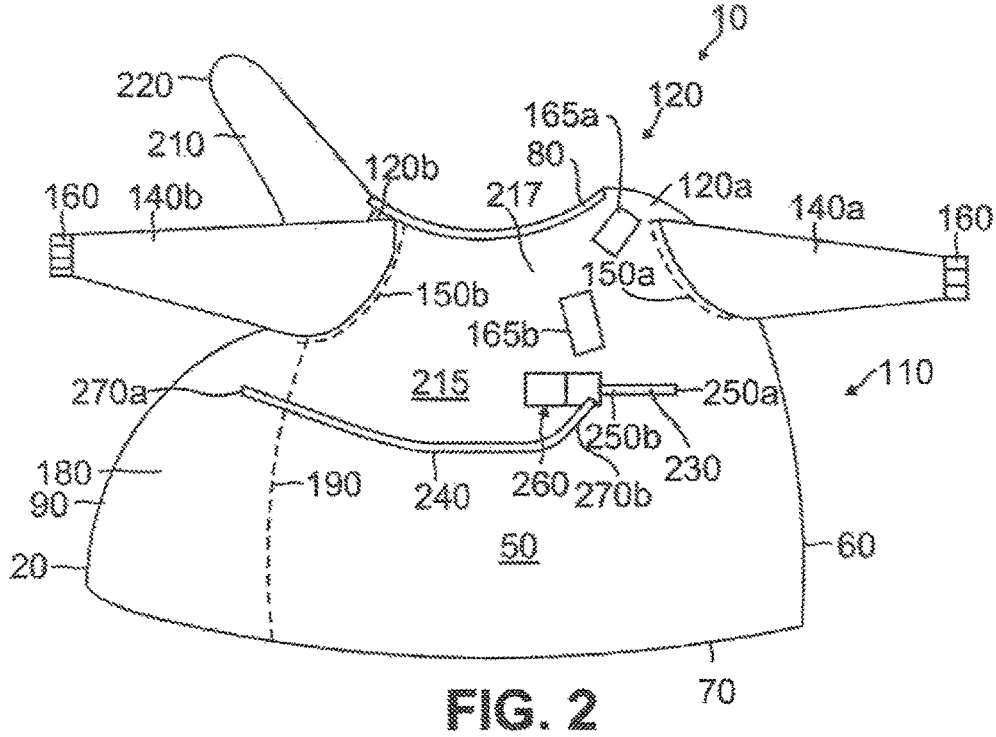
FIG. 2 is a view in elevation of an exterior of the first embodiment surgical gown of FIG. 1.

Referring now to the drawings and more particularly to FIGS. 1 and 2, there is shown a first embodiment surgical gown, generally referred to as 10, which is constructed in accordance with the present invention. Surgical gown 10, as will be described hereinafter in greater detail, provides an effective barrier to protect a surgery patient and operating room personnel from transfer of microorganisms, body fluids and particulates that might otherwise cause infections. For example, such infectious microorganisms might include Methicillin-Resistant *Staphylococcus Aureus* (MRSA), clostridia, streptococci, staphylococci, *E. coli* bacilli and other pathogens, bacterium and microbial organisms. Body fluid, such as blood, might contain blood-borne pathogens, such as Human Immunodeficiency Virus (HIV), Hepatitis B and Hepatitis C viruses. Particulates may be dried residue from disinfectants or chemicals.

Considering now surgical gown 10 in greater detail and with reference to the several figures, surgical gown 10 generally includes a number of component parts for providing the protection barrier as mentioned hereinabove and for helping to assure that operating room personnel remain sterile during a surgical procedure. In this regard, surgical gown 10 comprises a fabric panel 20 having a front panel portion 110 with a pair of spaced apart elongate sleeve members 140*a* and 140*b* respectively extending therefrom, an interior surface 40, an exterior surface 50 and a shoulder portion 120 having a shoulder flap 210. These component parts in their unique arrangement utilize the fabric panel 20 for draping a surgical operating room person, such as a surgeon 30. In this arrangement the shoulder portion 120 is connected to the pair of spaced apart elongate sleeve members 140*a* and 140*b*. The shoulder flap 210 extends away from the shoulder portion 120*b* at about the proximal end of sleeve member 140*b* a sufficient distance to drape over a shoulder of surgeon 30. The fabric panel 20 further includes a wrap around rear torso portion 180 for extending about one side of a mid area 215 of front torso portion 110. Rear torso portion 180 extends about the one side of mid area 215 of front torso portion 110 a sufficient distance to wrap around and completely drape at least an upper rear torso area of surgeon 30. The wrap around rear torso portion 180 terminates at its distal end at about an opposite side of the mid area 215 of front torso portion 110. The wrap around rear torso portion 180 has integrally connected thereto the shoulder flap 210 for extending over shoulder portion 120 at about the opposite side of mid area 215 of front torso portion 110, the shoulder flap 210 being adapted to be releasably secured to a securing area 217 at about the opposite side of the mid area 215 of the front torso portion 110.

Referring specifically to FIGS. 1 and 2, first embodiment surgical gown 10 may be disposable or reusable. When first embodiment surgical gown 10 is disposable (i.e., single use), first embodiment surgical gown 10 may be made of nonwoven material, such as a spread tow plastic film composite. The plastic film composite constituting the nonwoven fabric may be a laminate comprising polypropylene fibers and a polyethylene film. Such a laminate material reduces risk of strike-through or wicking-through by liquids that may carry the previously mentioned infectious microorganisms. Alternatively, when first embodiment surgical gown 10 is reusable, first embodiment surgical gown 10 may be made of a woven textile material, such as woven cotton or woven synthetic material. For example, the reusable material may have a taffeta weave made from continuous filament polyester and comprising about 95% to about 99% polyester and about 1% to about 5% cotton for reducing risk of strike-through or wicking-through by liquids, such as blood.

Referring again to FIGS. 1 and 2, first embodiment surgical gown 10 comprises a panel 20, such as a fabric panel made of woven material and having a predetermined contour or shape for draping a wearer thereof, such as a surgical operating room person. The surgical operating room person may be surgeon 30 (see FIG. 5). As shown in FIGS. 1 and 2, panel 20 defines an interior surface 40 that faces surgeon 30 after surgeon 30 dons first embodiment surgical gown 10 in a manner described in detail hereinbelow. Panel 20 also defines a sterile exterior surface 50 (FIG. 2) thereon that will face a sterile surgical field (not shown) wherein a surgical procedure is to be performed. Panel 20 also defines a generally arcuate-shaped first side edge 60 extending from a bottom edge 70 of panel 20 to a top edge 80 of panel 20. In addition, panel 20 defines a generally curvilinear second side edge 90 extending from bottom edge 70 of panel 20 to near top edge 80 of panel 20. A curvilinear portion 100 of second side edge 90 is disposed near top edge 80 for reasons disclosed hereinbelow.

Referring yet again to FIGS. 1 and 2, the panel 20 has previously mentioned front torso portion indicated generally at 110, and the shoulder portion indicated generally at 120. The shoulder portion 120 includes a first shoulder portion 120*a* and a second shoulder portion 120*b*. The shoulder portions 120*a* and 120*b* are integrally formed with front torso portion 110 and are located adjacent to top edge 80 of panel 20. Formed through first shoulder portion 120*a* and second shoulder portion 120*b* are spaced-apart arm openings, such as a first arm opening 130*a* and a second arm opening 130*b*, respectively. The purpose of first arm opening 130*a* and second arm opening 130*b* is to allow arms 135 (see FIG. 5) of the wearer or surgeon 30 of first embodiment surgical gown 10 to be inserted through arm openings 130*a* and 130*b* and into respective ones of a pair of sleeve members, such as a first sleeve member 140*a* and a second sleeve member 140*b*. Sleeve members140*a* and 140*b* extend outwardly from first shoulder portion 120*a* and second shoulder portion 120*b*, respectively.

Figure 19:
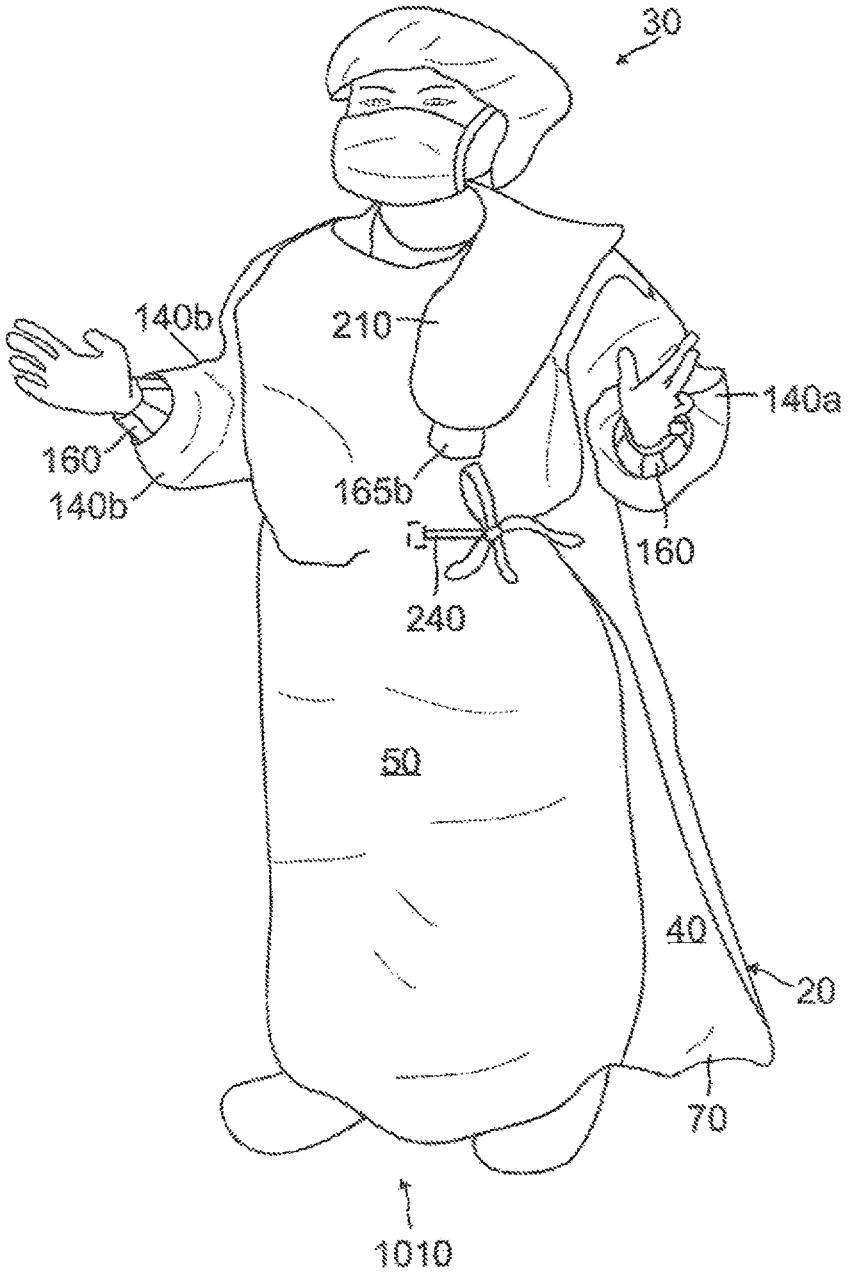
FIG. 19 is a view in perspective of the surgeon having tied the free ends of the pair of waist tie strings together to complete the donning procedure.
Figure 23:
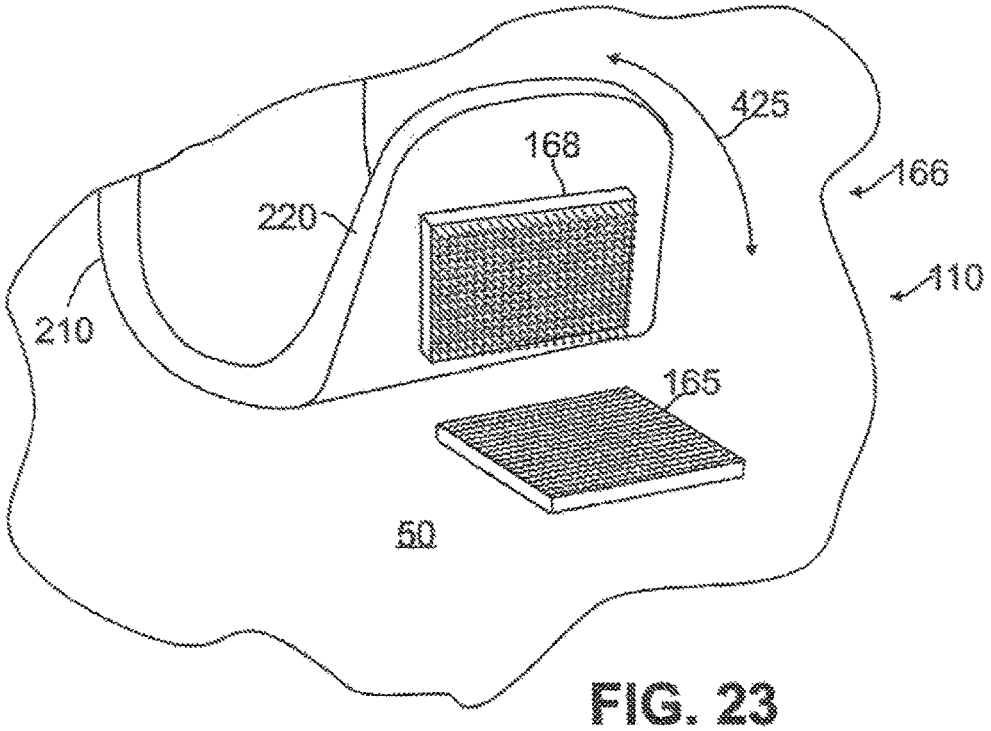
FIG. 23 is a fragmentary view in perspective of a first embodiment fastener for releasably securing the shoulder flap to the front torso portion of the panel belonging to either the first or second embodiment surgical gown, the first embodiment fastener being a hook-and-loop fastener arrangement.
Figure 24:
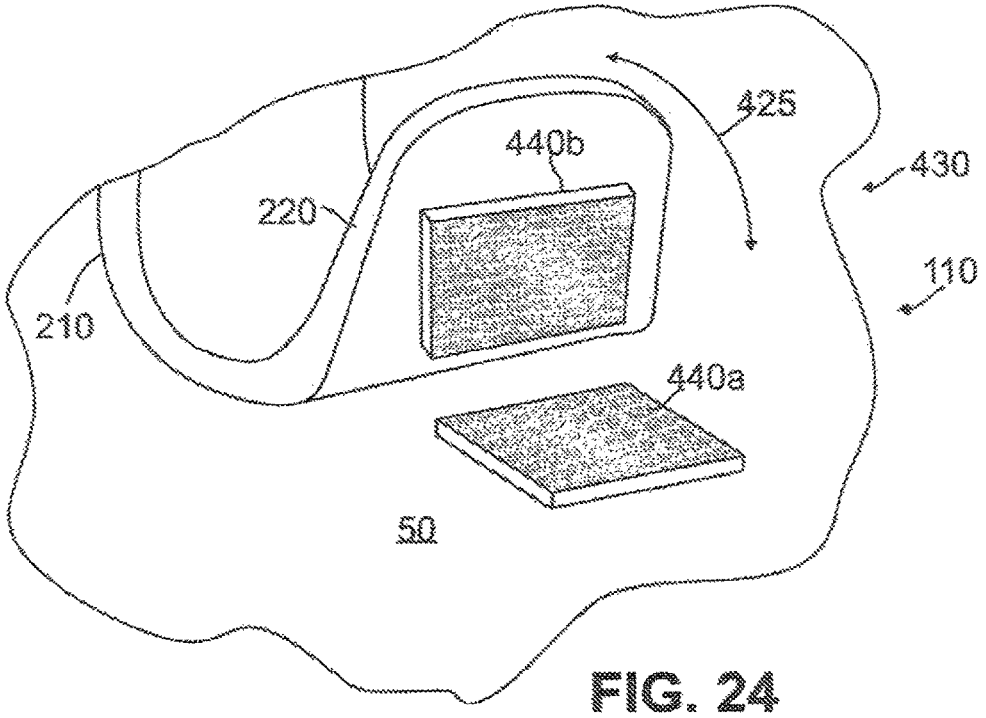
FIG. 24 is a fragmentary view in perspective of a second embodiment fastener for releasably securing the shoulder flap to the front torso portion of the panel belonging to either the first or second embodiment surgical gown, the second embodiment fastener being a removable pressure sensitive adhesive fastener arrangement.
Figure 25:
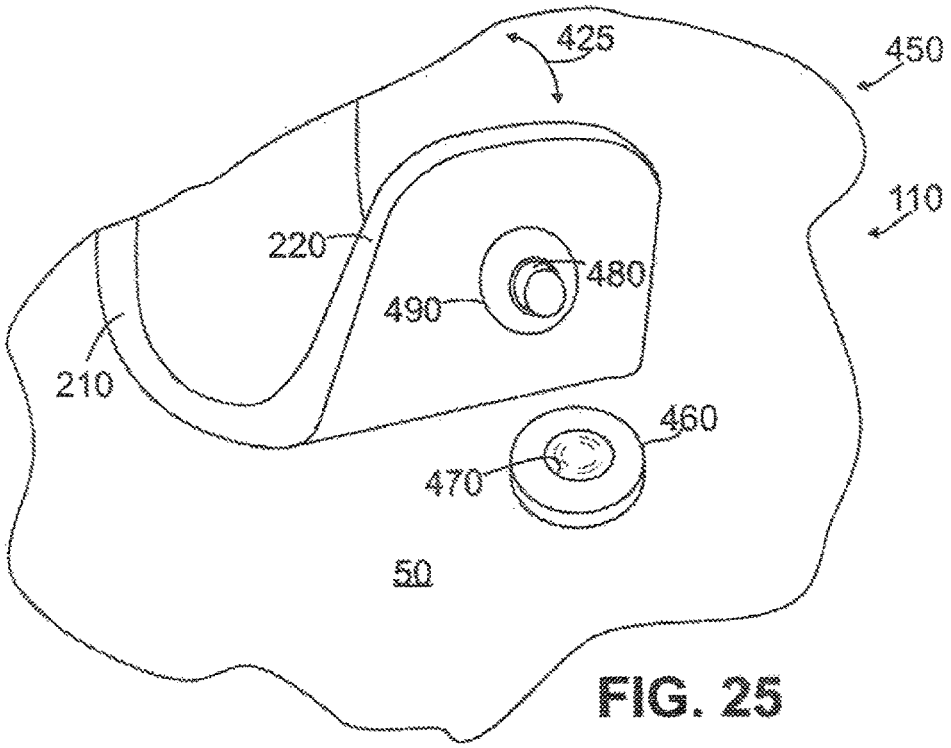
FIG. 25 is a fragmentary view in perspective of a third embodiment fastener for releasably securing the shoulder flap to the front torso portion of the panel belonging to either the first or second embodiment surgical gown, the third embodiment fastener being a snap-in fastener arrangement.
Figure 26:
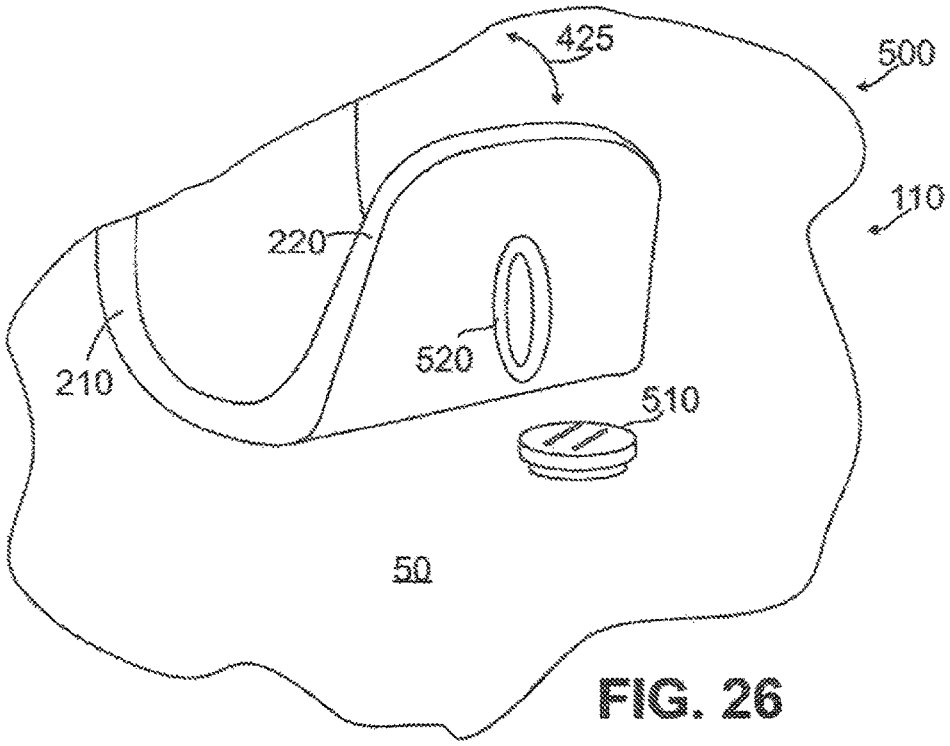
FIG. 26 is a fragmentary view in perspective of a fourth embodiment fastener for releasably securing the shoulder flap to the front torso portion of the panel belonging to either the first or second embodiment surgical gown, the fourth embodiment fastener being a button fastener arrangement.
Figure 27:
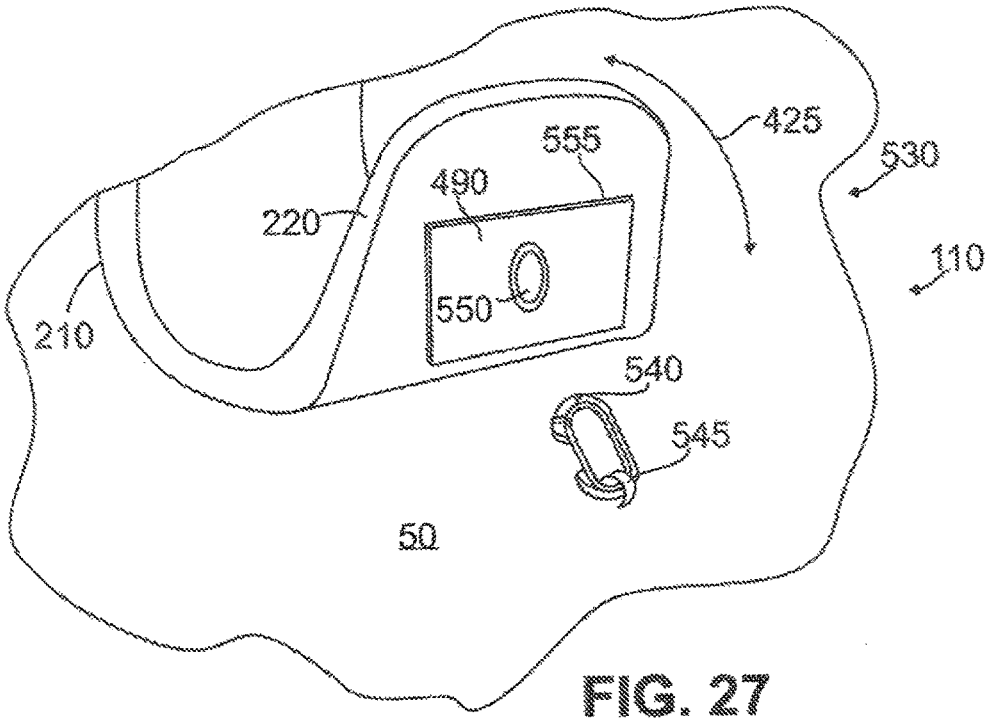
FIG. 27 is a fragmentary view in perspective of a fifth embodiment fastener for releasably securing the shoulder flap to the front torso portion of the panel belonging to either the first or second embodiment surgical gown, the fifth embodiment fastener being a clamp fastener arrangement.
Figure 28:
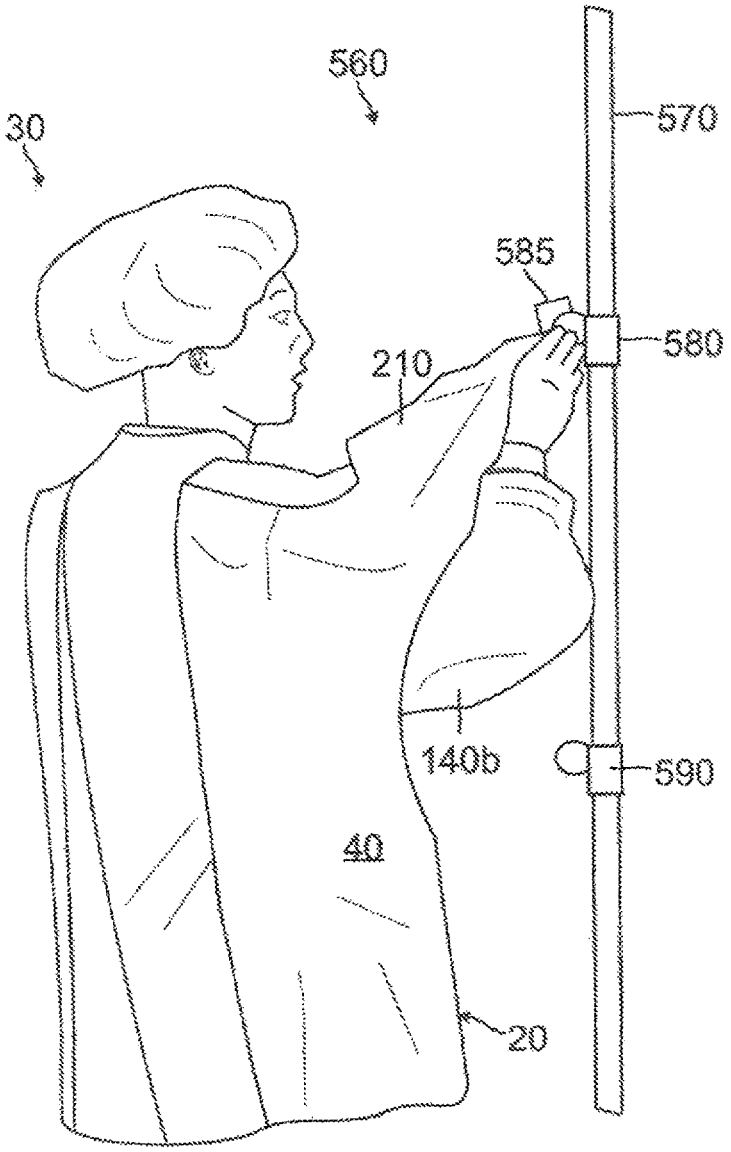
FIG. 28 is a view in perspective of the surgeon securing the shoulder flap to an uppermost support, or other attachment means, belonging to an upright pole in order to perform a self-donning procedure.
Figure 29:
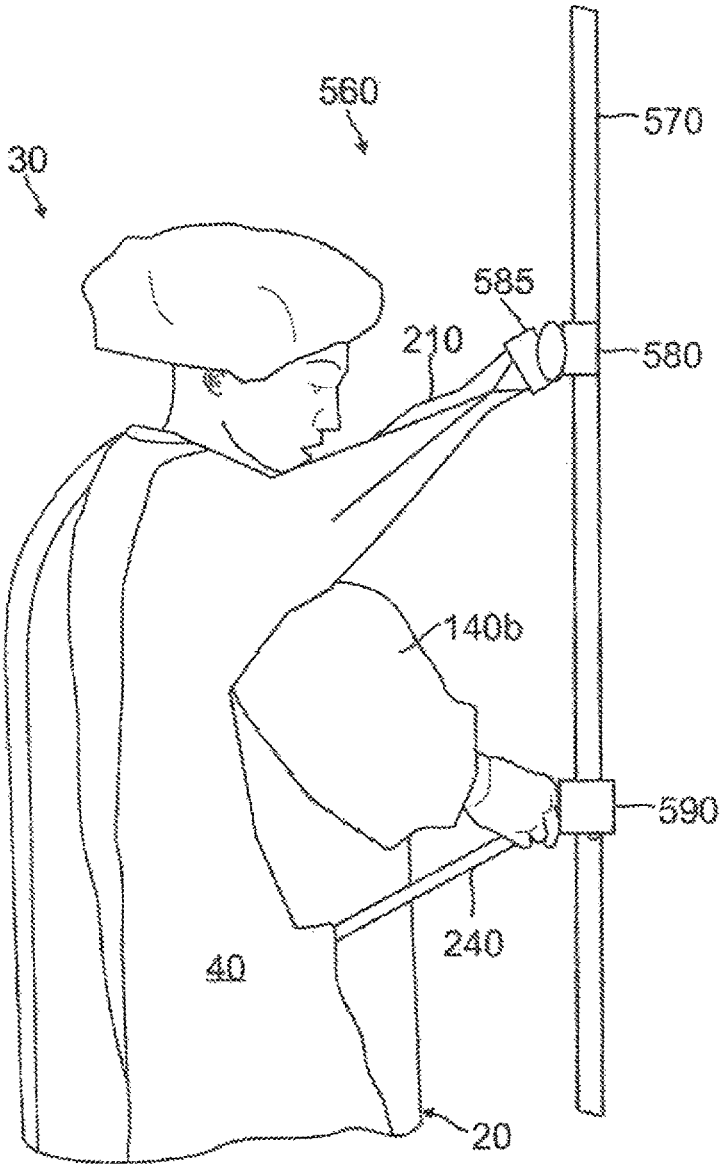
FIG. 29 is a view in perspective of the surgeon securing a waist tie string to a lowermost support, or other attachment means, belonging to the upright pole in order to perform the self-donning procedure.
Figure 30:
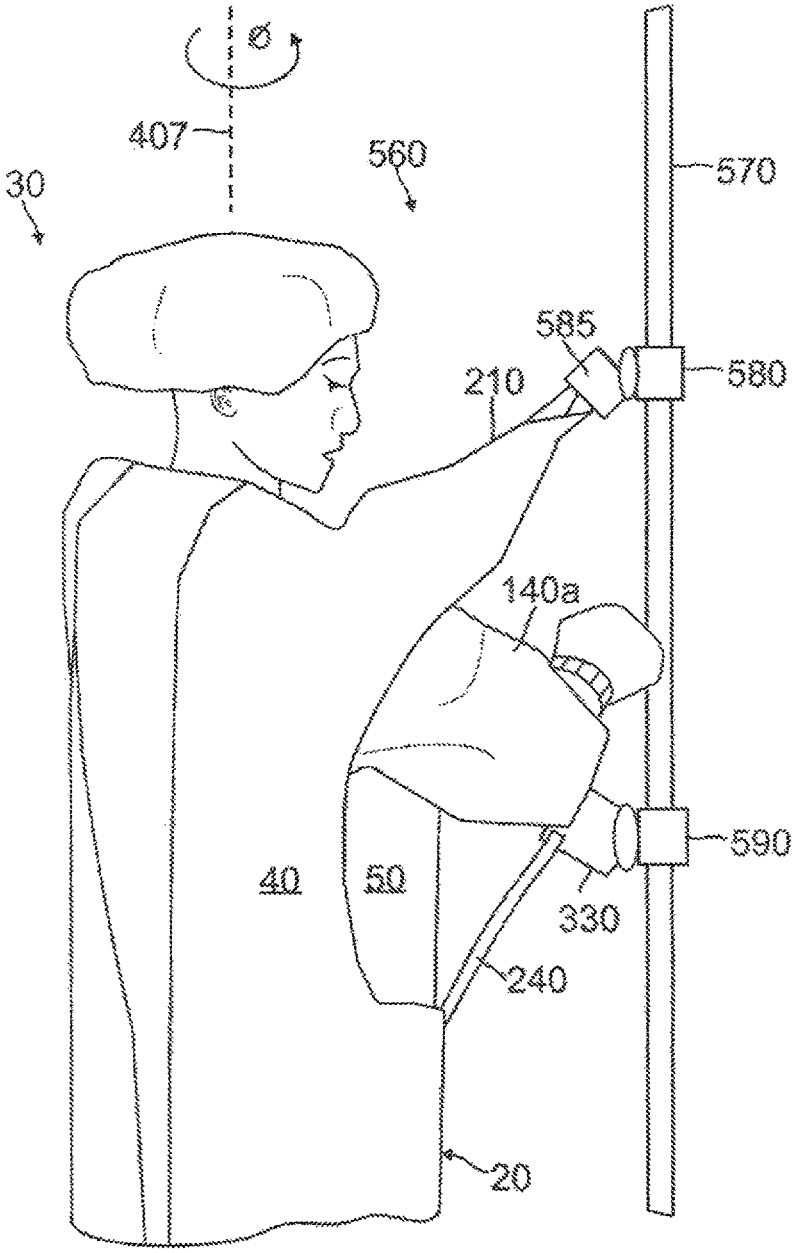
FIG. 30 is a view in perspective of the surgeon having secured the shoulder flap to the uppermost support and the waist tie string to the lowermost support in order to perform the self-donning procedure.
Figure 31:
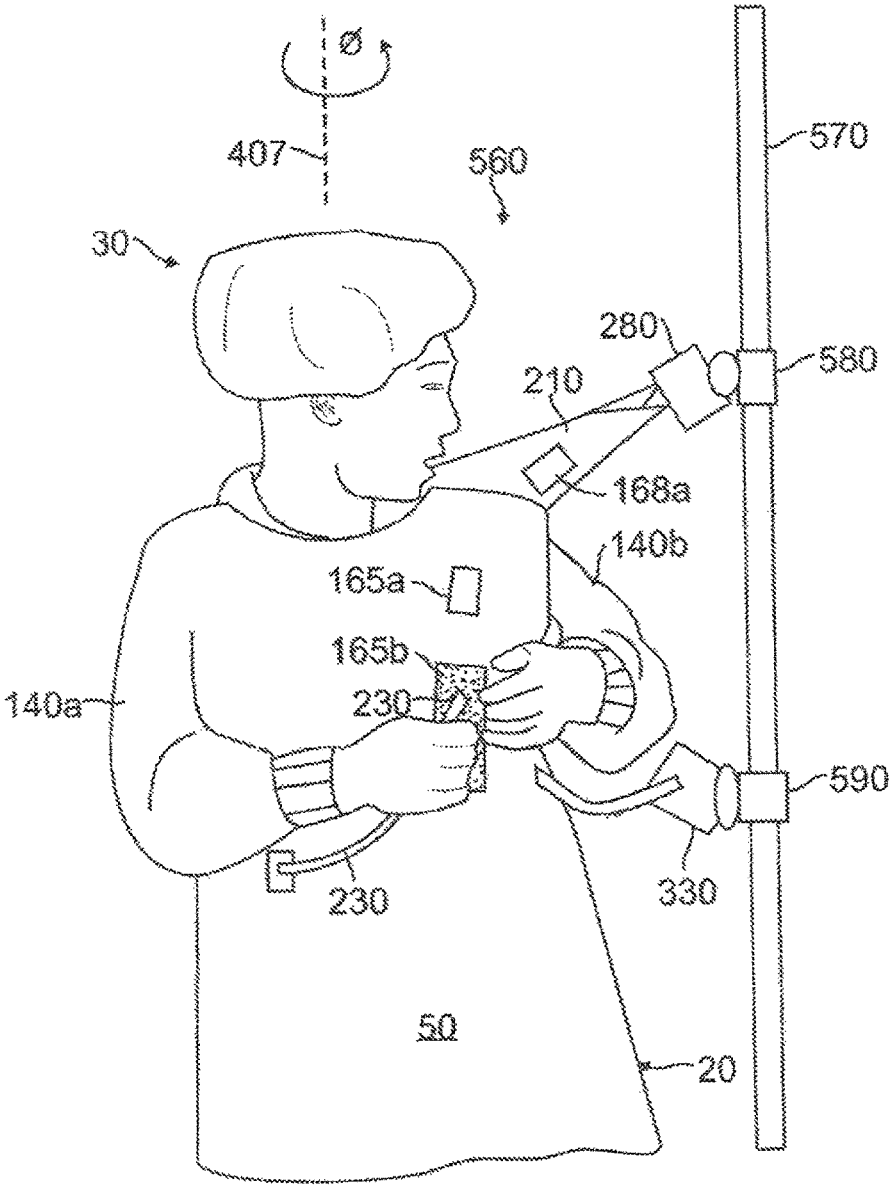
FIG. 31 is a view in perspective of the surgeon having secured the shoulder flap to the uppermost support and the waist tie string to the lowermost support and in the process of rotating 360 degrees in order to perform the self-donning procedure.
Figure 32:
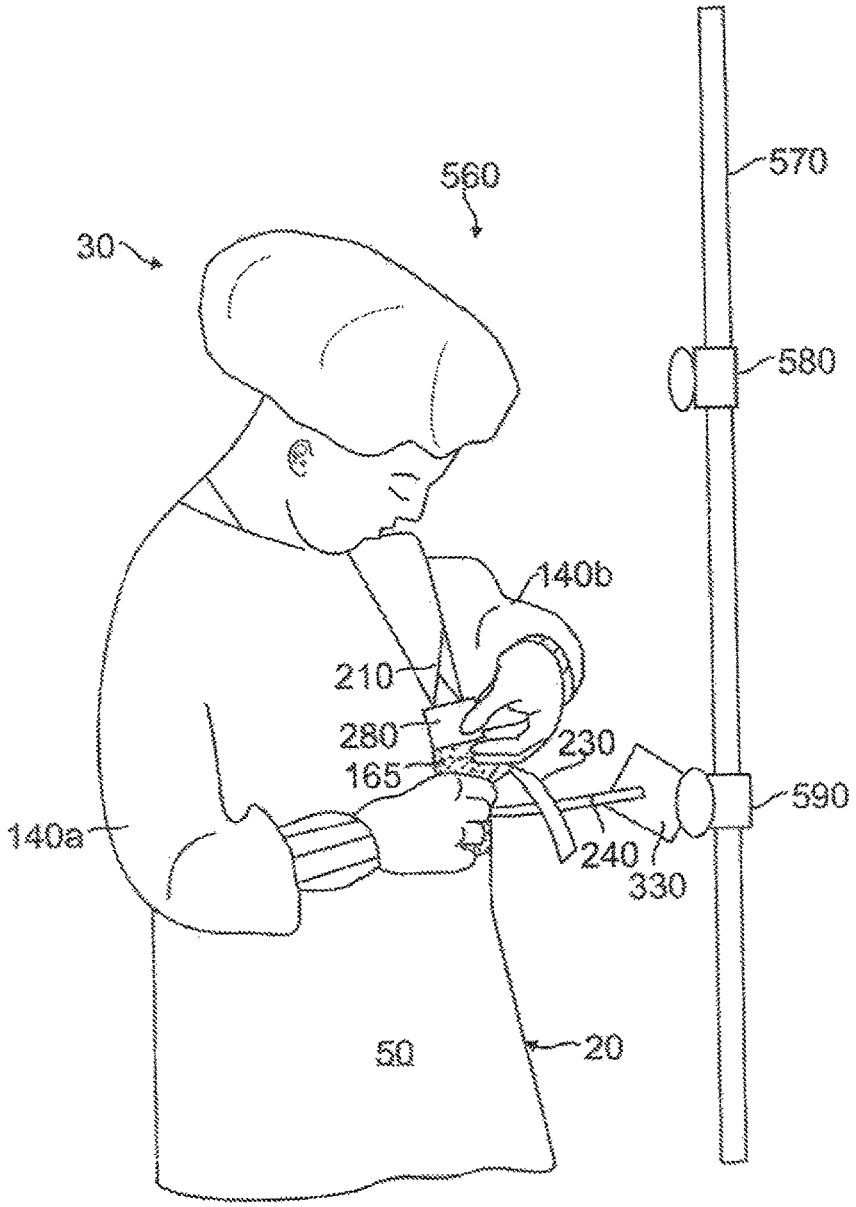
FIG. 32 is a view in perspective of the surgeon having completed the process of rotating 360 degrees in order to perform the self-donning procedure, this view also showing the surgeon having removed the shoulder flap from the uppermost support, but with the waist tie string still secured to the lowermost support.
Figure 33:
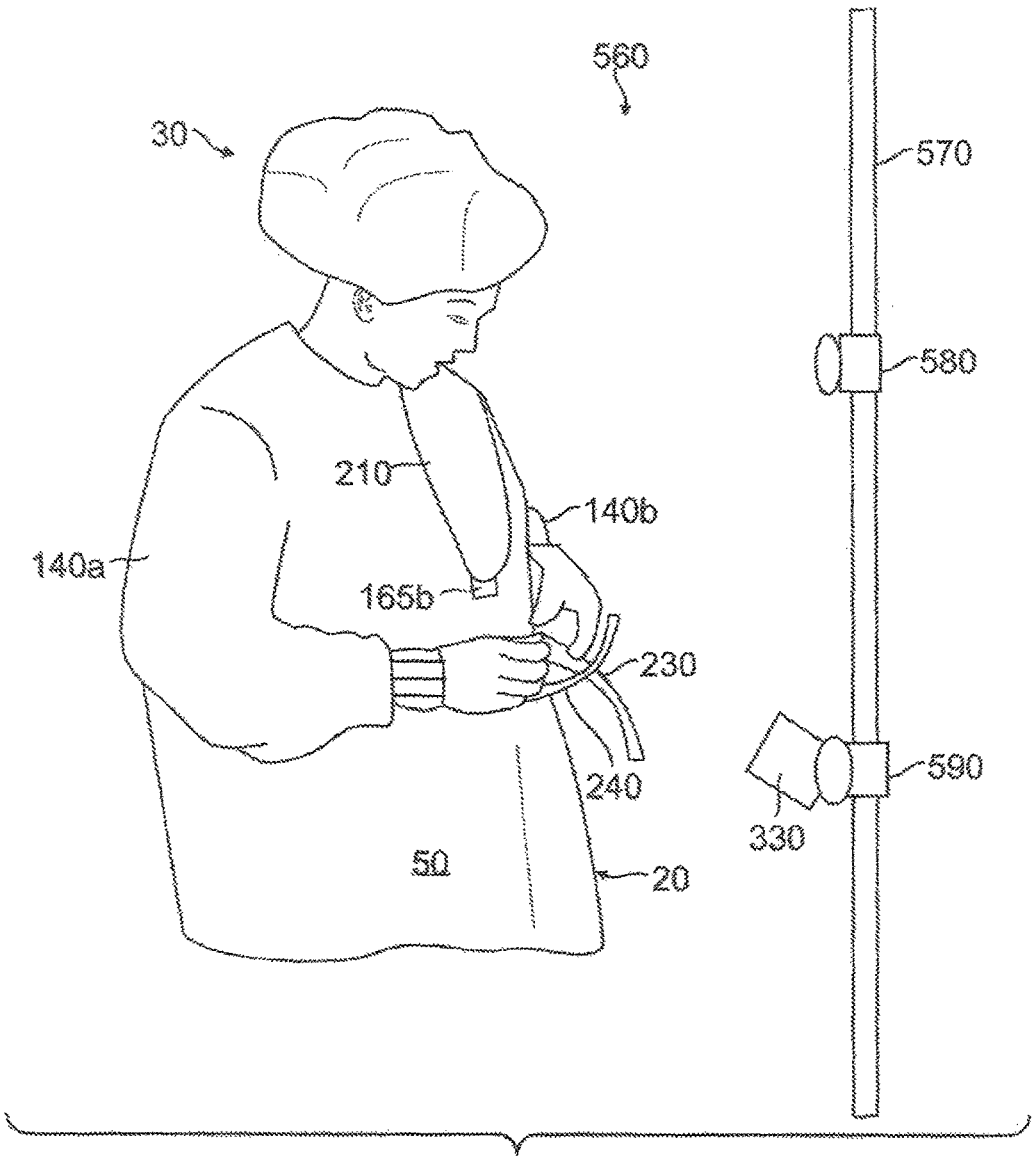
FIG. 33 is a view in perspective of the surgeon tying free ends of the pair of waist tie strings in order to complete the self-donning procedure.

As shown in FIGS. 1 and 2, ends of sleeve members 140*a* and 140*b* nearest front torso portion 110 are attached to front torso portion 110 by respective ones of first stitches 150*a* and second stitches 150*b*. Although attachment of sleeve members 140*a* and 140*b* may be by means of stitches 150*a* and 150*b*, it should be understood that sleeve members 140*a* and 140*b* may instead be attached to front torso portion 110 by means of ultrasonic bonding or welding. Each sleeve member 140*a* and 140*b* has a predetermined longitudinal length to facilitate draping arms 135 of the surgeon 30. In addition, each sleeve member 140*a* and 140*b* has an expandable elastic cuff or closure member 160 at about its distal end for helping to seal each distal end of sleeve members 140*a* and 140*b* around a respective wrist area of surgeon 30. A female loop member 165 belonging to a hook-and-loop fastener arrangement 166 (see FIG. 23) is attached to front torso portion 110 of panel 20 for reasons provided hereinbelow. Hook-and-loop fastener arrangement 166 may be substantially Nylon rather than felt or other fabric material is order to reduce likelihood of air borne particulate matter being released from hook-and-loop fastener arrangement 166. Release of particulate matter might otherwise lead to patient infection due to the migration of the particulate matter into the surgical site or may, at least partially, block catheter tubes during surgery. As shown in FIGS. 1 and 2, female loop members 165*a* and 165*b* may be attached to front torso portion 110 by any suitable means such as by an adhesive. Female loop members 165*a* and 165*b* releasably engage complementary male hook members or tabs 168*a* and 168*b* (see FIGS. 1-2 and 19), for reasons provided hereinbelow.

Referring again to FIGS. 1 and 2, a generally trapezoidal-shaped reinforcing layer 170 is attached to interior surface 40 of front torso portion 110 for protecting surgeon 30 from inadvertent strike-through by sharps or liquids during the surgical procedure. Reinforcing layer 170 extends from between openings 130*a* and 130*b* near top edge 80 to near bottom edge 70. Reinforcing layer 170 may be made of the same material as panel 20 or a different material. In the case of reusable gowns comprising a woven material, the different material may be a woven plastic laminate impervious to liquid penetration. In the case of single-use gowns made from non-woven material, the reinforcing layer 170 will protect surgeon 30 from inadvertent strike-through by sharps during the surgical procedure because the non-woven material (e.g., spread tow plastic film composite) inherently prevents penetration of sharps through the non-woven material. Thus, in addition to providing a barrier to strike-throughs by sharps, reinforcing layer 170 also provides an added barrier to prevent strike-through or wicking-through of liquids that might otherwise penetrate panel 20 and contact surgeon 30. Reinforcing layer 170 may be attached to interior surface 40 by any suitable means, such as by an adhesive or by sewn threads.

Again referring to FIGS. 1 and 2, and as previously mentioned, panel 20 includes front torso portion 110 and shoulder portions 120*a* and 120*b*. Panel 20 also has a wrap around rear torso portion 180. The rear torso portion 180 defines previously mentioned curvilinear second side edge 90 and also defines a seam 190 extending from top edge 80 that is near second arm opening 130*b*, to bottom edge 70. Seam 190 attaches rear torso portion 180 to front torso portion 110 and may be a sewn attachment having a plurality of threads defining seam 190 or an adhesive attachment. In order to prevent microorganisms, liquids and particulate matter from entering interior 40 of first embodiment surgical gown 10 through gaps in the threads defining seam 190, the seam 190 may be sealed by a suitable sealant, such as a solventless silicone elastomer liquid sealer that cures when exposed to moisture in the air. A sealer suitable for this purpose may be the "DOW CORNING® 734 FLOWABLE SEALANT", which may be available from the Dow Corning Corporation located in Midland, Mich. U.S.A. Among its properties, this particular sealant is flowable when applied, has a Durometer 27 Shore A hardness value, elongation of 315%, nonvolatile content of 95%, "tack-free time" of 13 minutes in 50% relative humidity, tear strength of 17.1 pounds per inch, and a tensile strength of 217.6 pounds per square inch. Tack free time is the amount of time a surface is no longer tacky to the touch. Alternatively, seam 190 may be sealed by an ultrasonic sealing process. Similarly, sleeve members 140*a* and 140*b* may be attached to front torso portion 110 by means of sewn threads 150*a* and 150*b*, respectively. Threads 150*a* and 125*b* may be sealed, such as by a solvent silicone elastomeric liquid sealer less by a suitable sealant, or by means of ultrasonic bonding.

Figure 11:
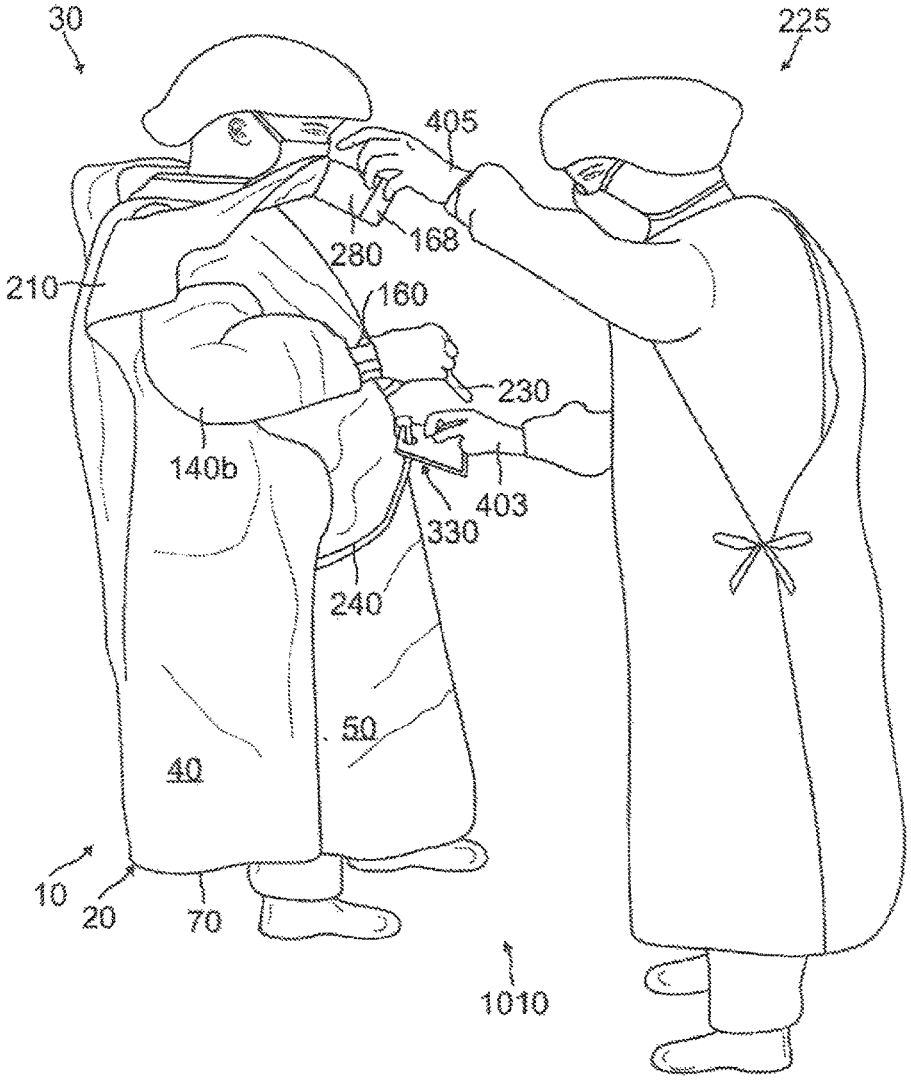
FIG. 11 is a view in perspective of the surgeon or scrub nurse having separated the breakable quick-release transfer card into two portions, the surgeon holding one portion and the scrub nurse holding the other portion, this view also showing the scrub nurse holding a shoulder flap by means of a should flap tab.
Figure 12:
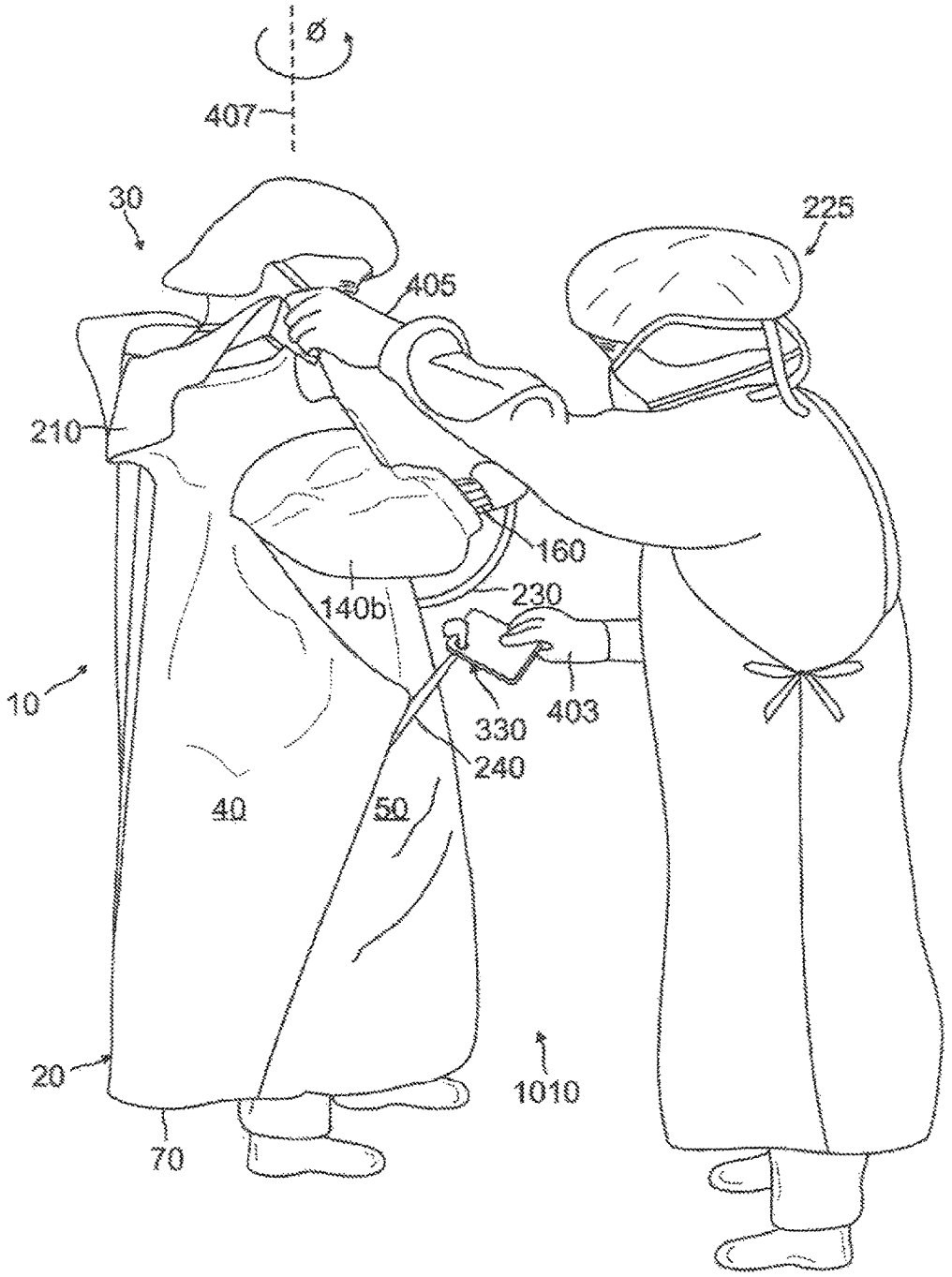
FIGS. 12-13 are perspective views of the surgeon engaging and continuing in a counterclockwise rotation about a vertical axis and through a 360 degree angle theta "Ø" while the surgeon holds one portion of the quick-release transfer card and while the scrub nurse holds both the other portion of the quick-release transfer card and the shoulder flap tab
Figure 13:
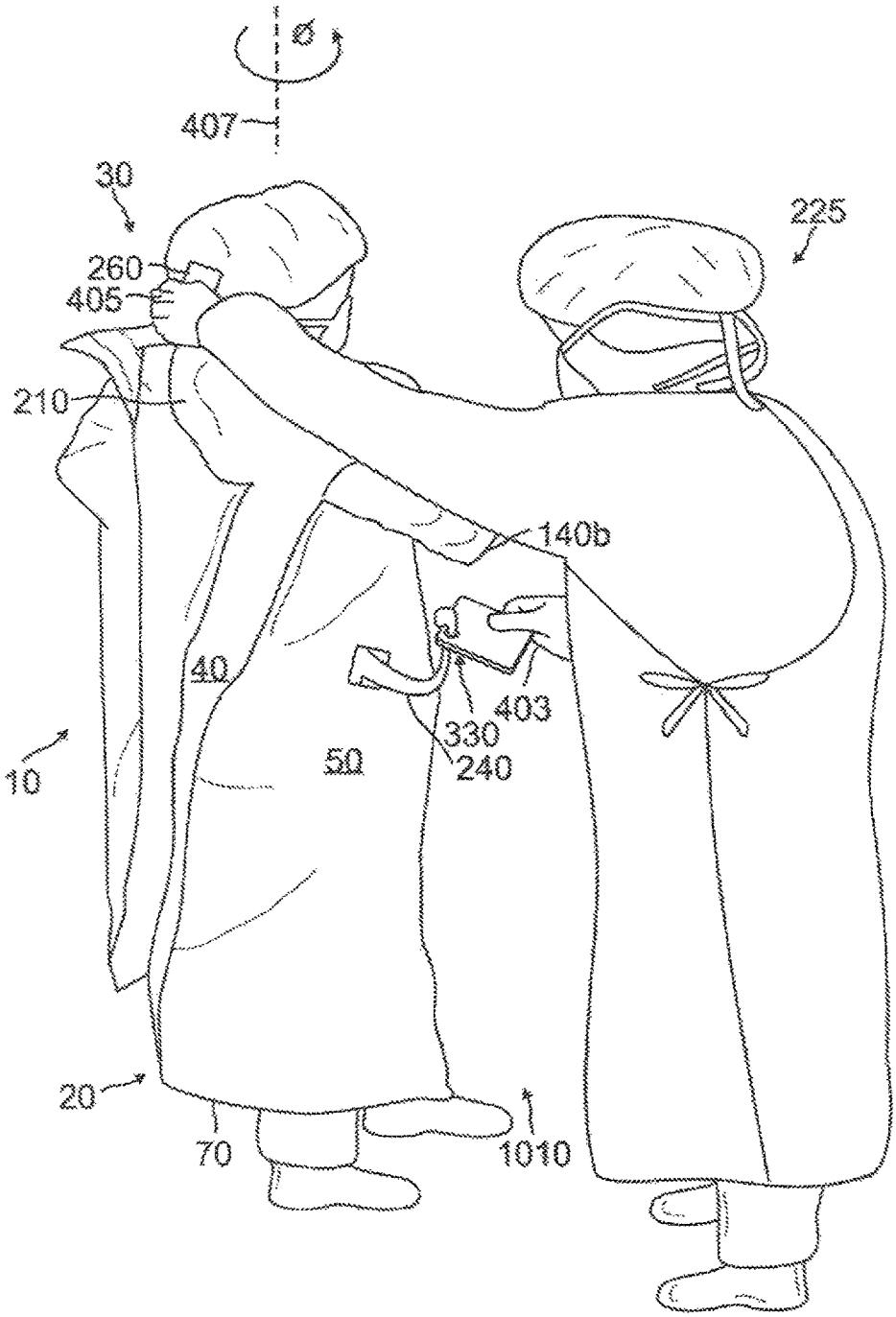
Figure 14:
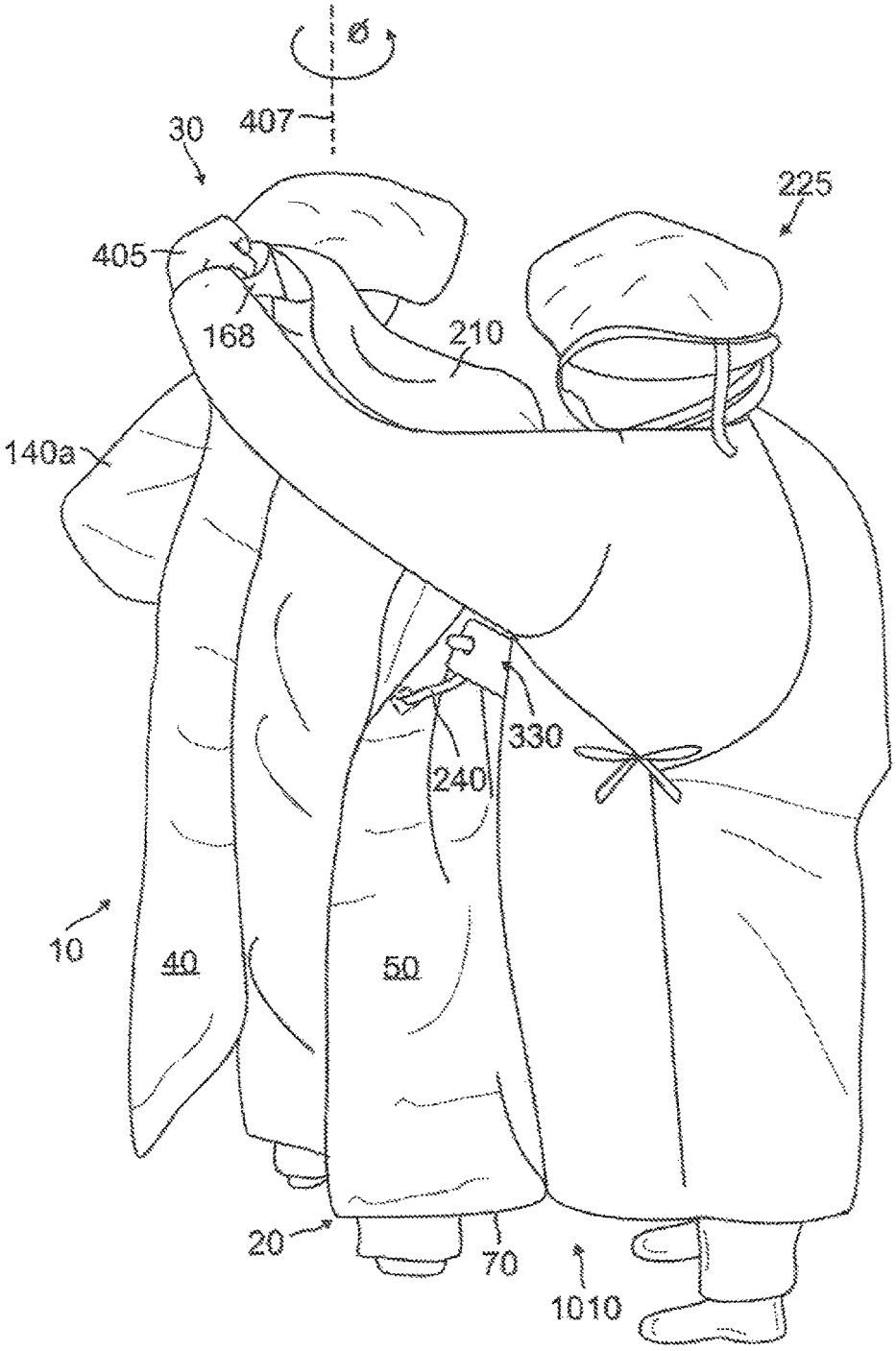
FIG. 14 is a view in perspective of the surgeon further continuing his 360 degree counterclockwise rotation while the surgeon holds one portion of the quick-release transfer card and while the scrub nurse simultaneously holds both the other portion of the quick-release transfer card and the shoulder flap tab.
Figure 15:
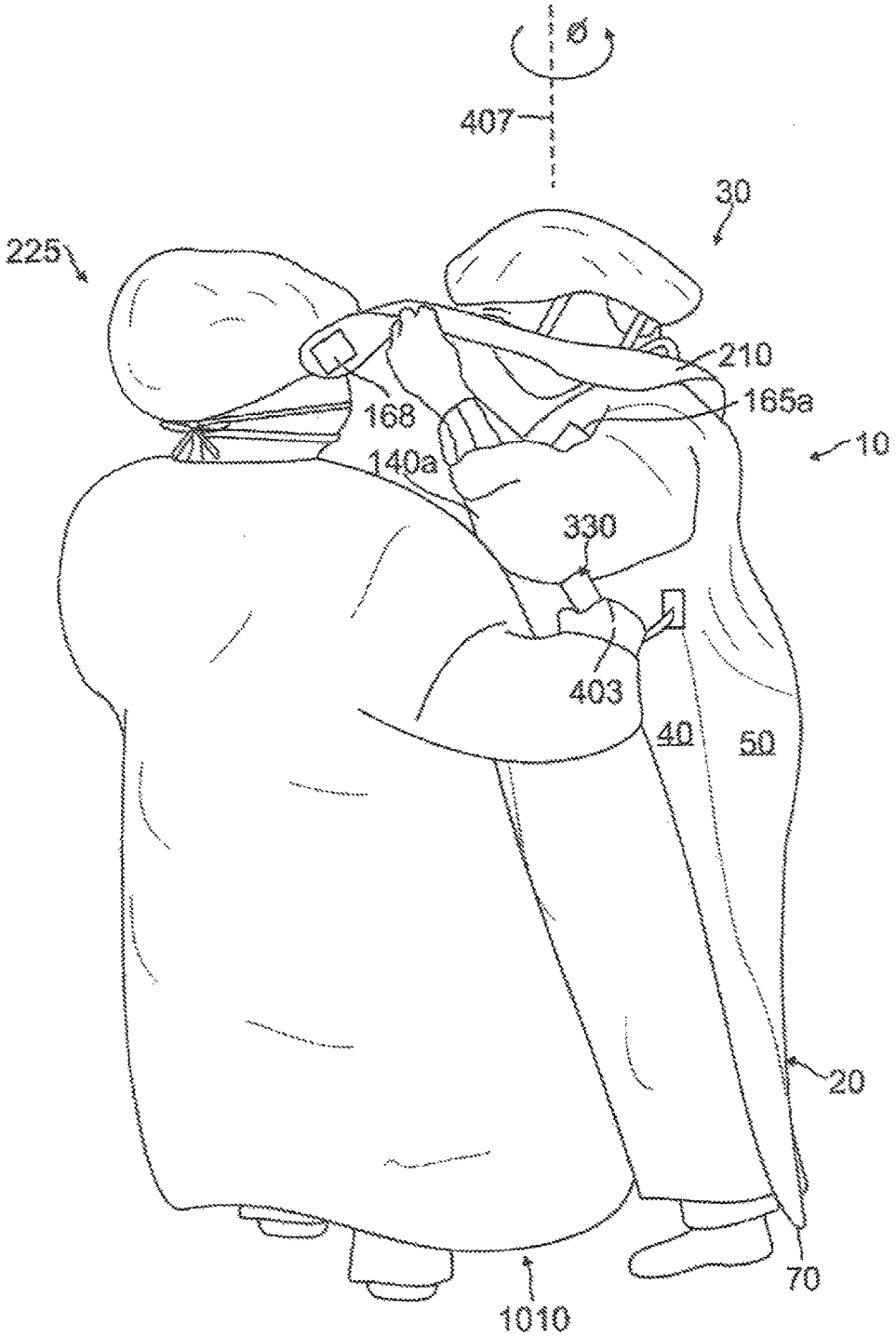
FIG. 15 is a view in perspective of the surgeon nearing completion of his 360 degree counterclockwise rotation while the surgeon holds one portion of the quick-release transfer card and while the scrub nurse holds the other portion of the quick-release transfer card, this view also showing the surgeon having accepted possession of the shoulder flap from the scrub nurse.
Figure 16:
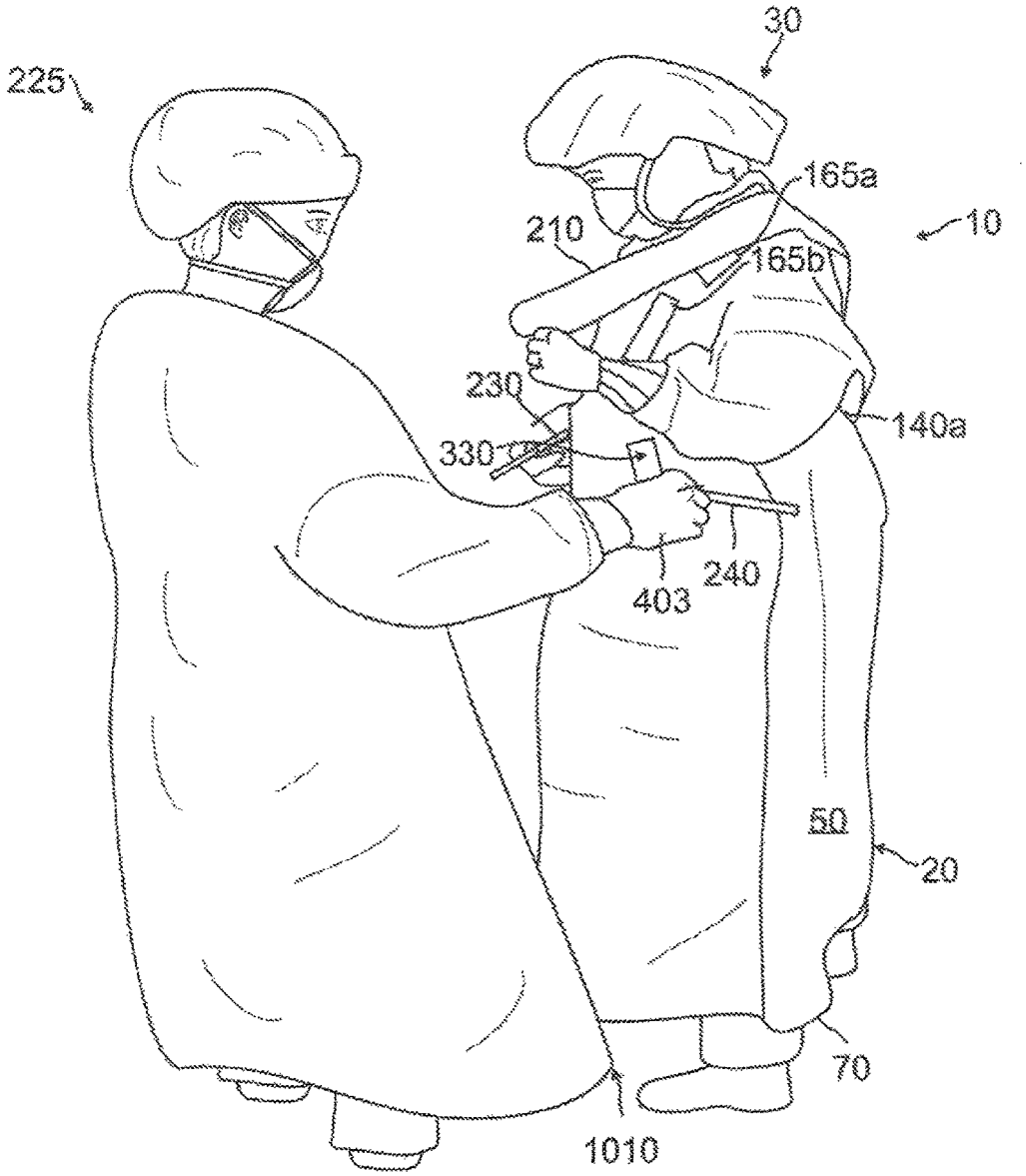
FIGS. 16-17 are perspective views of the surgeon beginning to releasably attach the shoulder flap to the front torso portion of the panel, and separating the free ends of the pair of waist tie strings from the quick-release transfer card.
Figure 17:
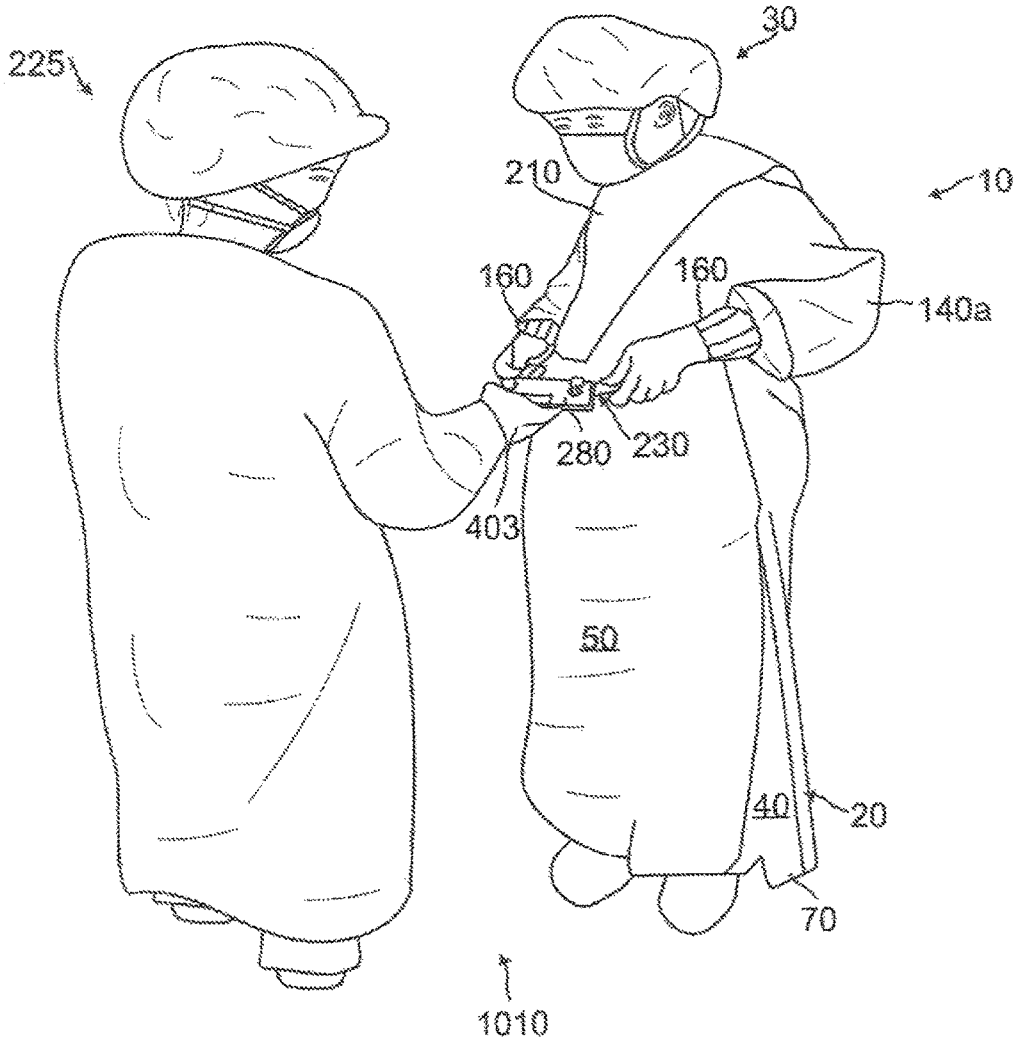
Figure 17A:
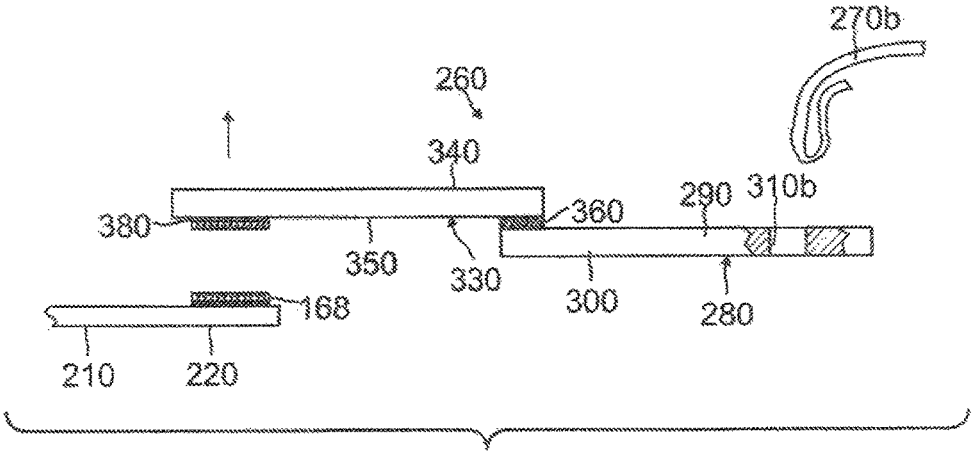
FIG. 17A, is a view in perspective of the quick-release transfer card releasably separated from the shoulder flap tab, and the pair of waist tie strings.
Figure 18:
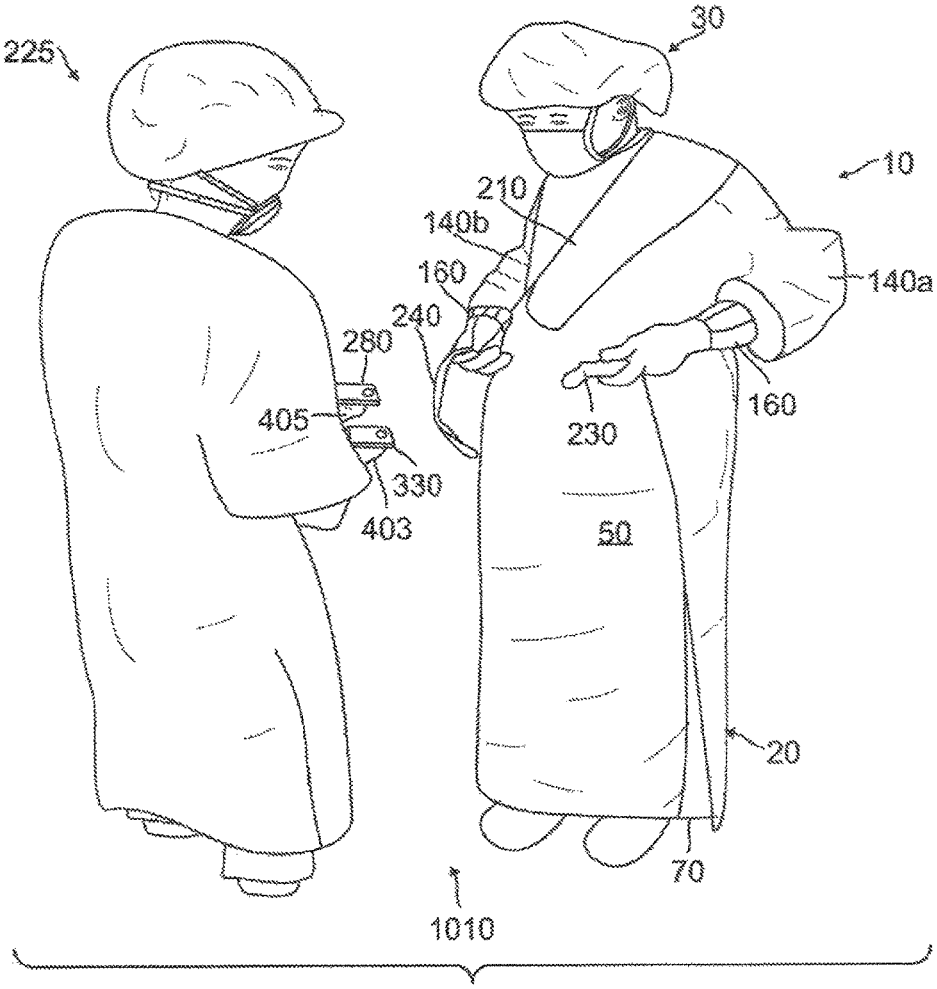
FIG. 18 is a view in perspective of the surgeon having separated the free ends of the pair of waist tie strings from their respective portions of the quick-release transfer card and beginning to tie the free ends together, this view also showing the scrub nurse possessing both portions of the quick-release transfer card.

Referring again to FIGS. 1 and 2, wrap around rear torso portion 180 has an elongate shoulder flap 210 that is of sufficient length to extend over shoulder portion 120*a* at about the opposite side of a mid area 215 of front torso portion 110. Shoulder flap 210 is adapted to be releasably secured to an area at about the opposite side of mid area 215 of front torso portion 110. In the embodiment shown, shoulder flap 210 is releasably secured to front torso portion 110 by previously mentioned hook-and-loop fastener arrangement 166 (see FIG. 23). The hook-and-loop fastener arrangement 166 comprises female loop member 165 that is engageable with the previously mentioned male hook shoulder flap tab 168. More specifically, a distal end 220 of shoulder flap 210 includes previously mentioned shoulder flap tab 168 that forms the male part of hook-and-loop fastener arrangement 166. As described in more detail hereinbelow, a scrub nurse 225 (see FIG. 11) maneuvers shoulder flap 210 over shoulder portion 120*a* as surgeon 30 dons first embodiment surgical gown 10. Scrub nurse 225 will grasp male hook shoulder flap tab 168 and releasably engage male hook shoulder flap tab 168 with female loop member 165 after shoulder flap 210 has been extended over shoulder portion 120*a* and positioned on front torso portion 110 of panel 20.

Figure 8:
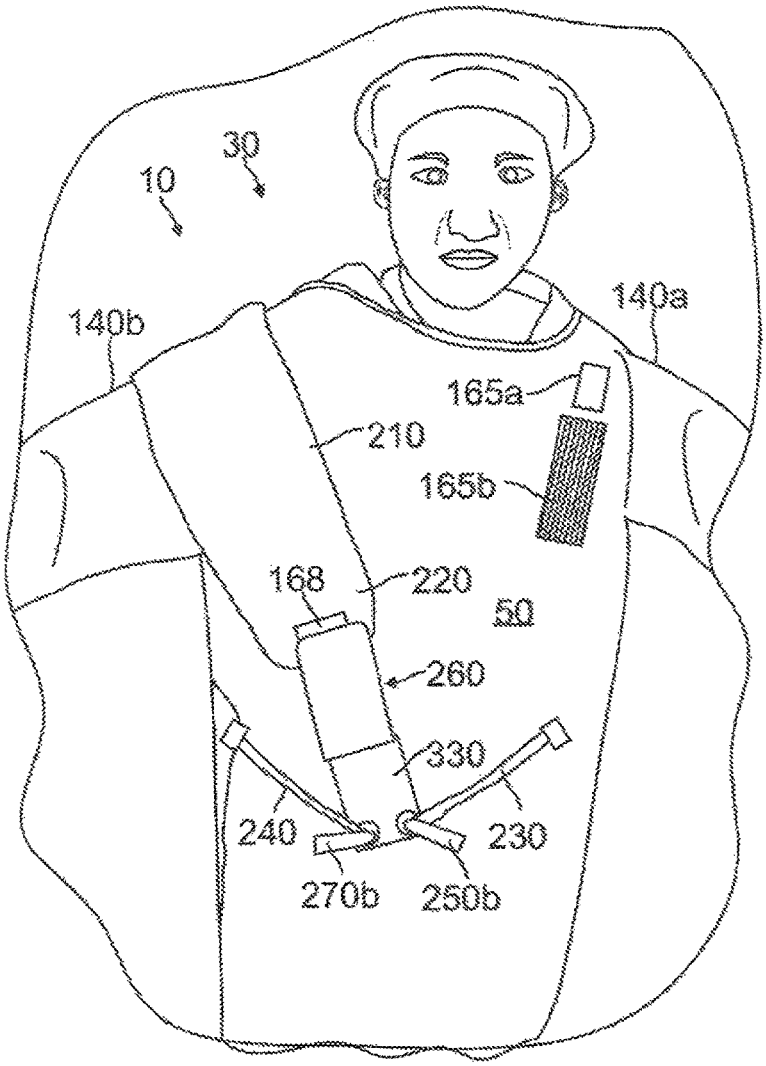
FIG. 8 is a view in perspective of the surgeon with his arms and shoulders donned with the first embodiment surgical gown in position for separating a breakable quick-release transfer card into two portions to facilitate completing the donning process.
Figure 9:
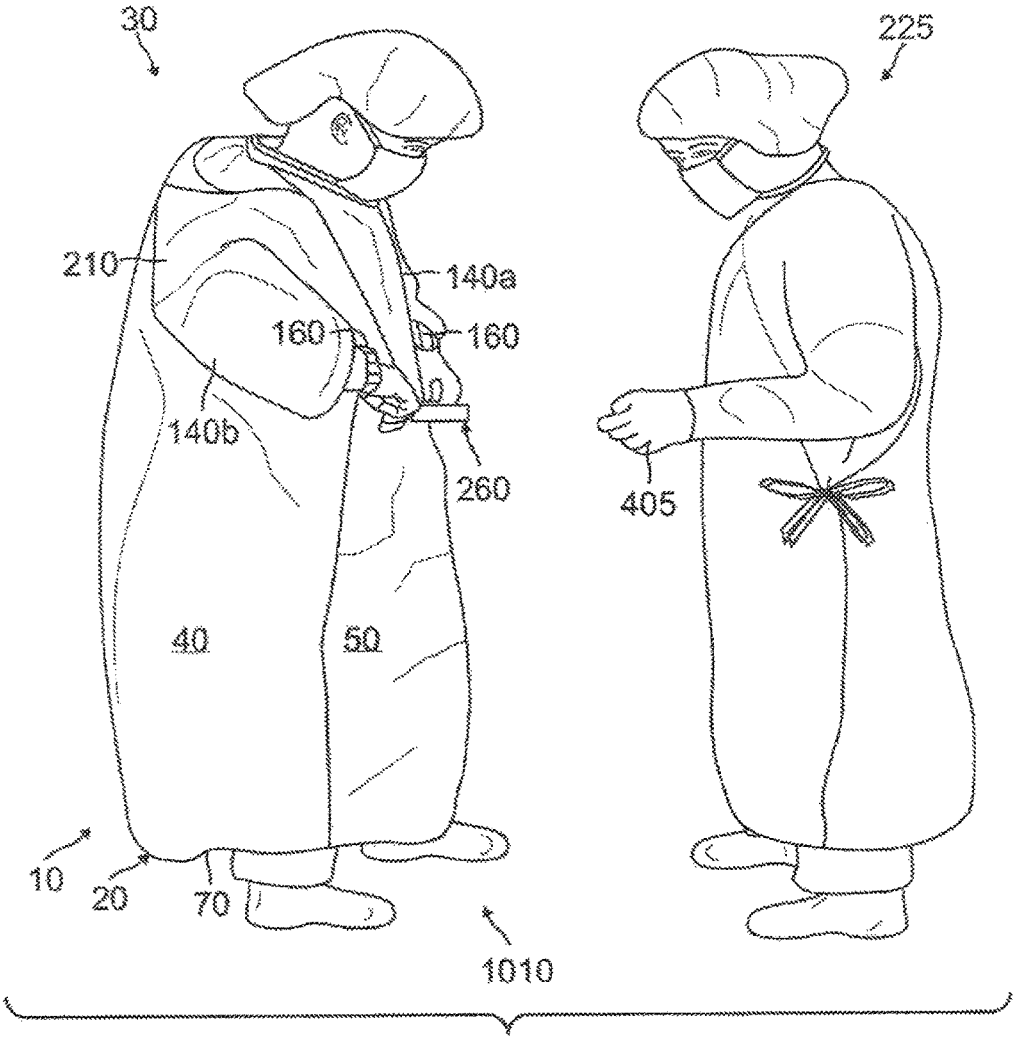
FIGS. 9-9A are perspective views of the surgeon separating the breakable quick-release transfer card into two portions, the quick-release transfer card having free ends of a respective pair of waist tie strings releasably secured thereto.
Figure 9A:
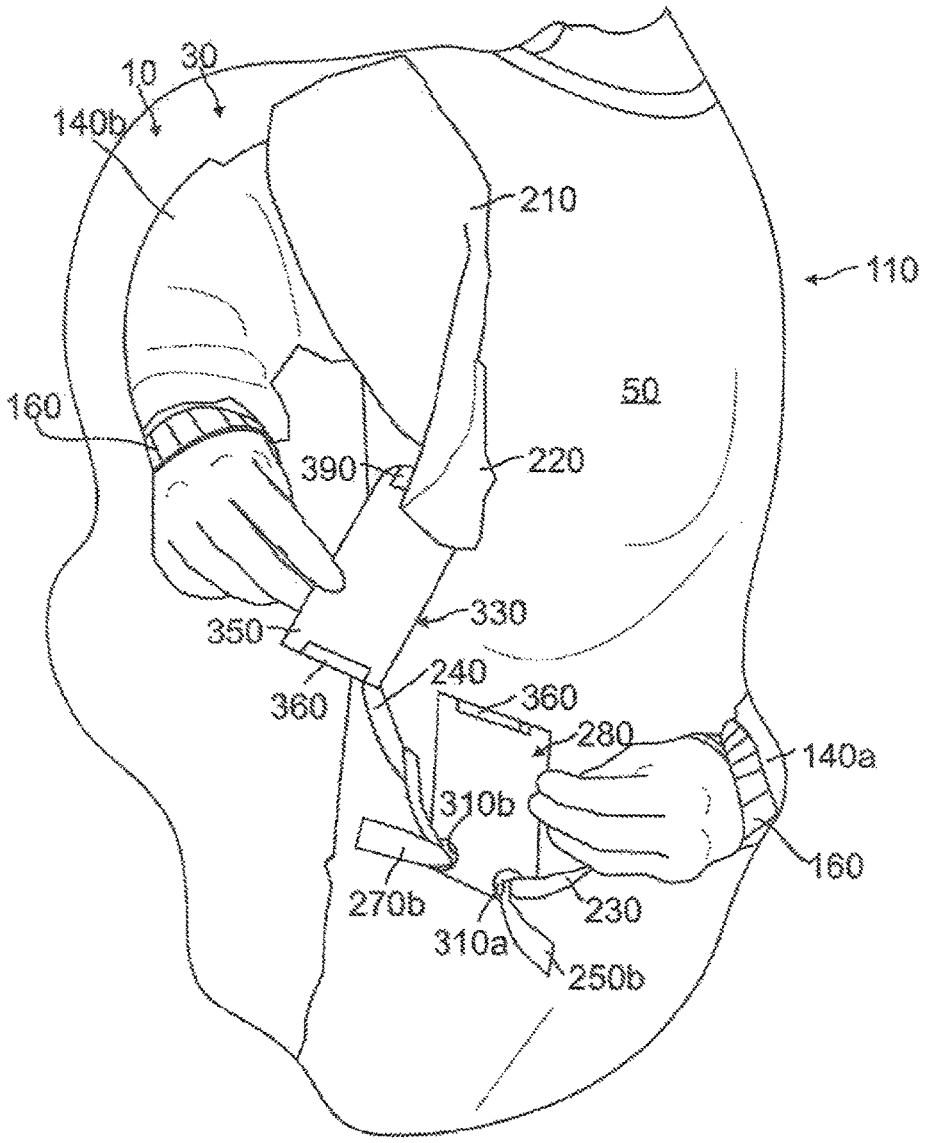

As shown in FIGS. 2 and 8, a pair of waist tie strings comprising a first waist tie string 230 and a second waist tie string 240 are attached to exterior surface 50 of panel 20 for securing rear torso portion 180 of panel 20 to front torso portion 110 of panel 20. First waist tie string 230 has a first end 250*a* affixed to front torso portion 110, such as by stitching or ultrasonic welding. First waist tie string 230 also has a second end 250*b* releasably secured to a breakable quick-release transfer card 260. Structure of quick-release transfer card 260 is described in detail hereinbelow. Also, as best seen in FIG. 2, second waist tie string 240 has a first end 270*a* affixed to rear torso portion 180, such as by stitching or ultrasonic welding. Second waist tie string 240 also has a second end 270*b* releasably secured to quick-release transfer card 260. After release from quick-release transfer card 260, second end 250*b* of first waist tie string 230 and second end 270*b* of second waist tie string 240 become free ends that can be tied together as described hereinbelow.

Figure 3:
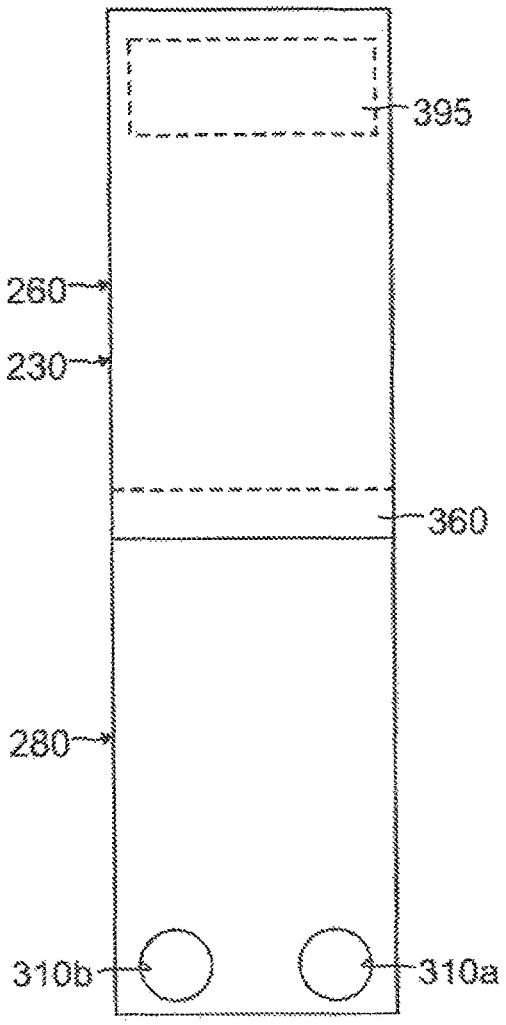
FIG. 3 is a plan view of a first embodiment quick-release transfer card, the first embodiment quick release transfer card having holes for receiving the free ends of a pair of waist tie strings releasably attached thereto.
Figure 4:
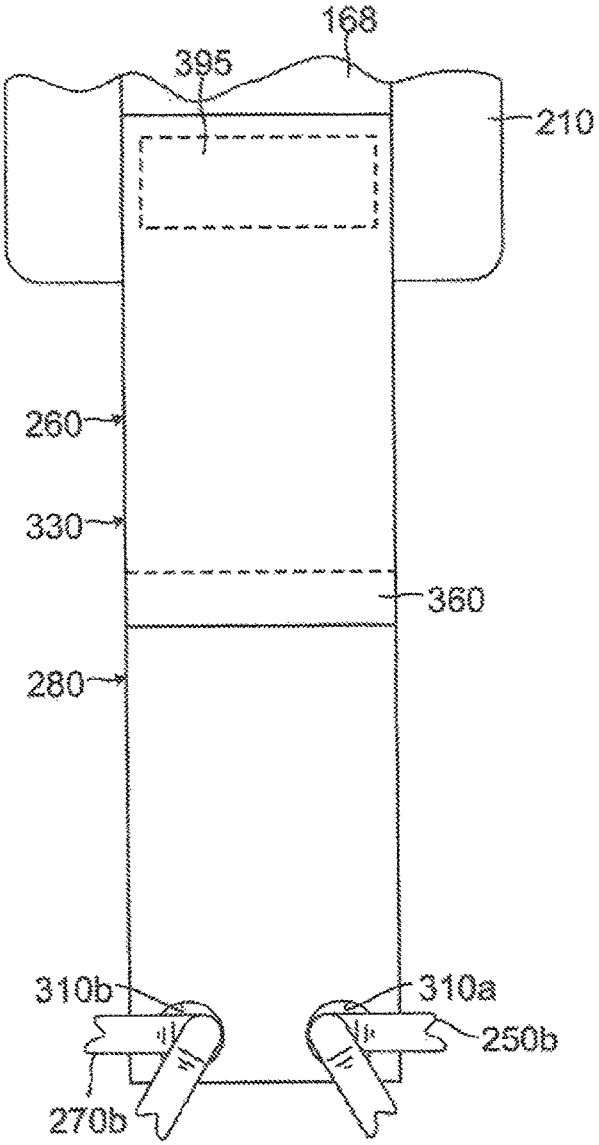
FIG. 4 is a view in partial elevation of the first embodiment quick-release transfer card.
Figure 4A:
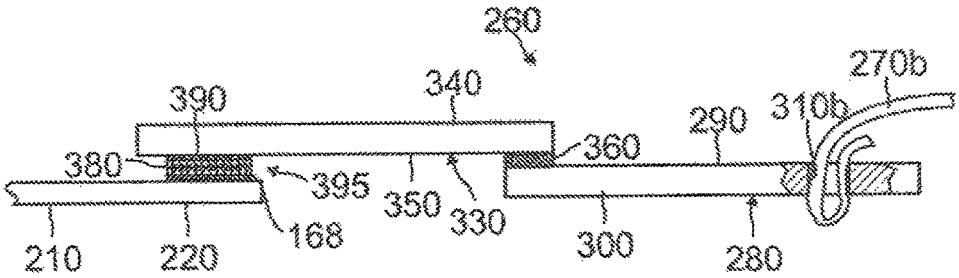
FIG. 4A is a view in partial elevation of the first embodiment quick-release transfer card.
Figure 5:
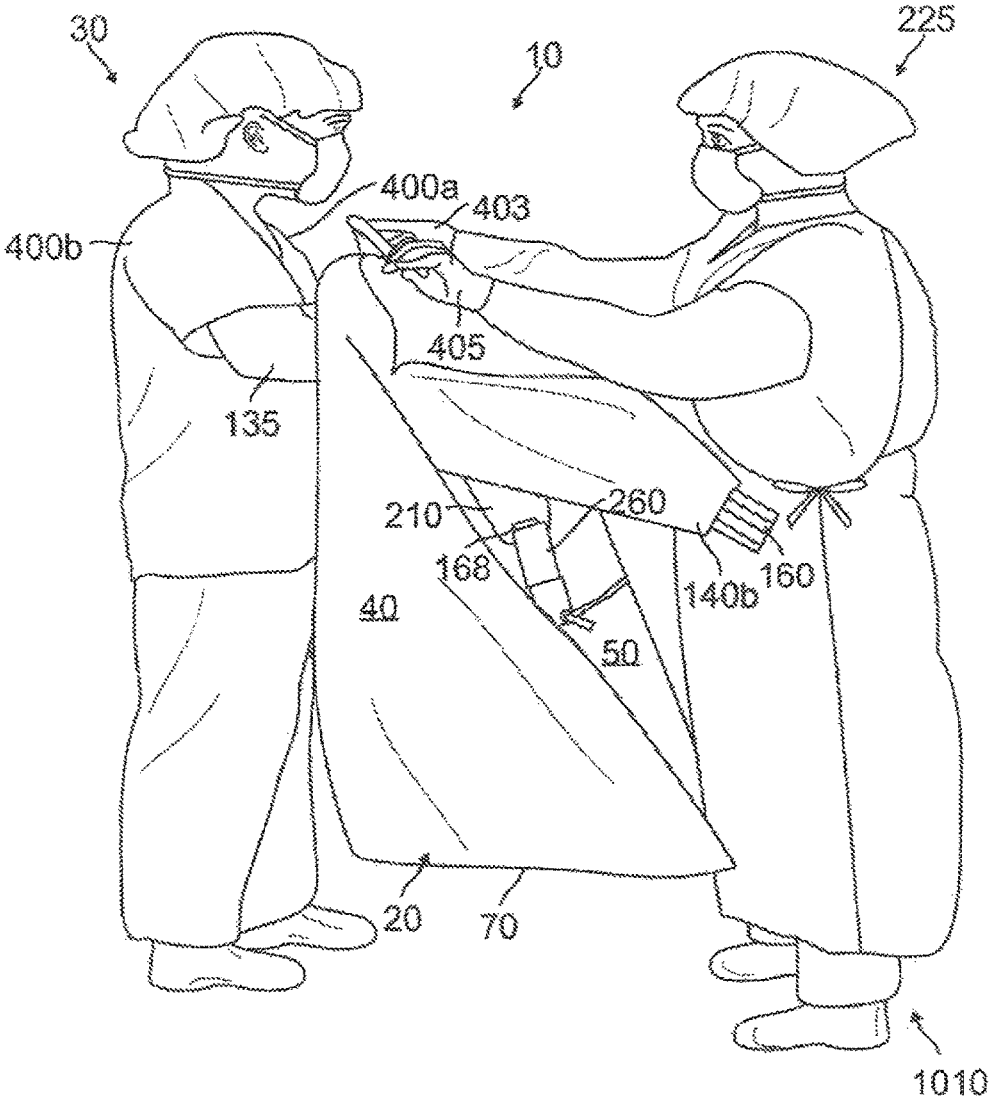
FIG. 5 is a view in perspective of an operating room person, such as a scrub nurse, assisting a surgeon in donning the first embodiment surgical gown, this view showing the surgeon beginning the process of inserting his arms into a pair of sleeves belonging to the first embodiment surgical gown.
Figure 10:
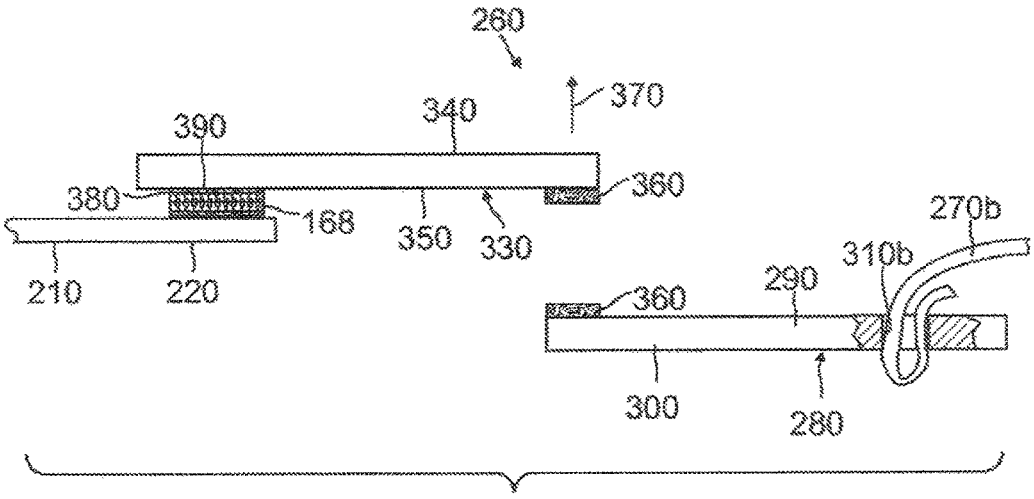
FIG. 10 is a view in partial elevation of the first embodiment quick-release transfer card, this view showing portions of the first embodiment quick-release transfer card having been separated or "broken" into two parts.

Referring to FIGS. 3, 4 and 5, the structure of first embodiment breakable quick-release transfer card 260 will now be described in detail. In this regard, quick-release transfer card 260 comprises a first segment 280 having an upper surface 290 and an undersurface 300. Attached to undersurface 300, such as by a suitable permanent adhesive (not shown), is a male hook portion 310 of a hook-and-loop fastener 315. Male hook portion 310 is capable of engaging a female loop portion 320 of hook-and-loop fastener 315. Female loop portion 320 is attached to second end 250*b* of first waist tie string 230, such as by a suitable permanent adhesive (not shown). Thus, second end 250*b* of first waist tie string 230 is releasably attached to quick-release transfer card 260 in a transverse hole 310*a* by means of hook-and-loop fastener 315. In this manner, first waist tie string 230 can be quickly released from quick-release transfer card 260 due to the hook-and-loop structure of hook-and-loop fastener 315. Quick-release transfer card 260 further comprises a second segment 330 having an upper surface 340 and an undersurface 350. Second segment 330 is releasably connected to first segment 280 by an adhesive layer 360 interposed therebetween. Adhesive layer 360 comprises a pressure sensitive removable adhesive for forming a temporary bond between first segment 280 and second segment 330. In this regard, the removable adhesive may be a rubber-resin dispersion, a modified-acrylic dispersion, or the like. For reasons provided hereinbelow, first segment 280 may be manually separated from second segment 330, such as in the general direction of an arrow 370 (see FIG. 10). In this sense, quick-release transfer card 260 is "breakable" because first segment 280 is separable from second segment 330 in the manner described immediately hereinabove. In addition, quick-release transfer card 260 defines a transverse hole 310*b* therethrough for releasably receiving second end 270*b* of second waist tie string 240. In this regard, second end 270*b* of second waist tie string 240 may be folded into hole 310*b* in order to be releasably received in hole 310*b*. The folded engagement of second waist tie string 240 in hole 310*b* allows second waist tie string 240 to be quickly released from quick-release transfer card 260 by sharply and firmly pulling on second waist tie string 240.

Figure 6:
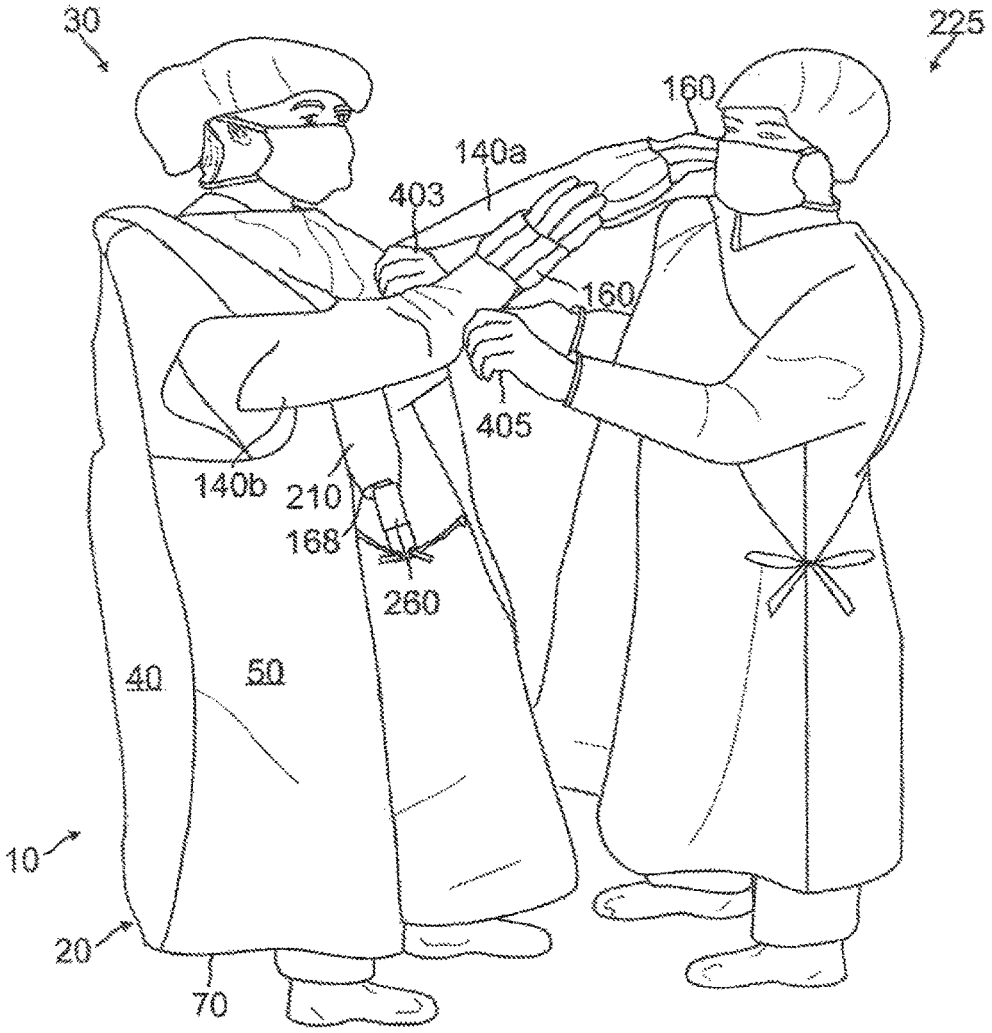
FIG. 6 is a view in perspective of an operating room person, such as a scrub nurse, assisting a surgeon in donning the first embodiment surgical gown, this view showing the surgeon substantially mid-way through the process of inserting his arms into the pair of sleeves belonging to the first embodiment surgical gown.
Figure 7:
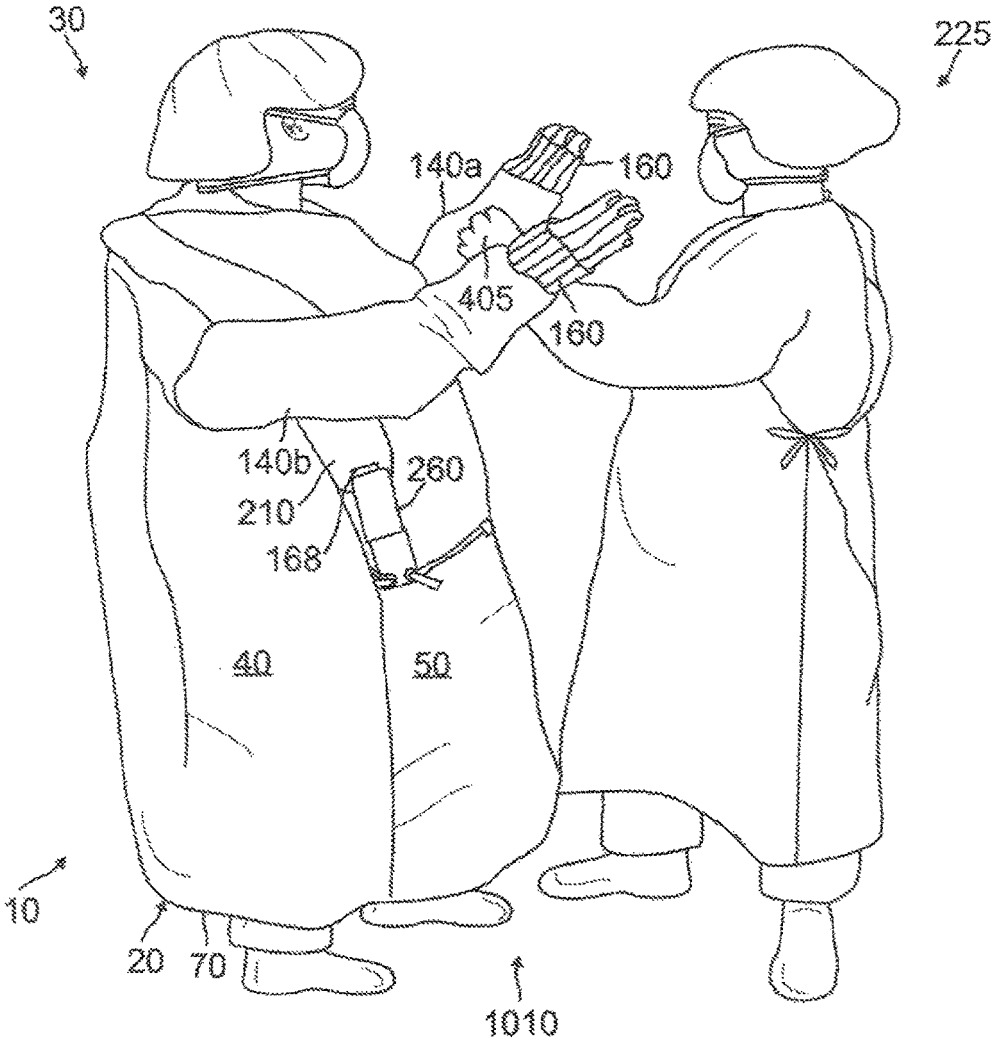
FIG. 7 is a view in perspective of the scrub nurse assisting the surgeon in donning the first embodiment surgical gown, this view showing the surgeon having substantially completed the process of inserting his arms into the pair of sleeves belonging to the first embodiment surgical gown.

As best seen in FIG. 6, a second embodiment quick-release transfer card 380 is substantially similar to first embodiment quick-release transfer card 260, except second end 270*b* of second waist tie string 240 includes a hook-and-loop male portion 390 that is engageable with hook-and-loop female portion 320 of first waist tie string 230 for releasably and quickly connecting first waist tie string 230 to second waist tie string 240 in order to avoid the time-consuming process of tying waist tie strings 230 and 240.

Considering now the method of using or donning 1010 surgical gown 10 in greater detail with reference to FIGS. 1, 2, and 5-8, scrub nurse 225 assists surgeon 30 in donning first embodiment surgical gown 10 by guiding sleeve members 140*a* and 140*b* onto arms 135 of surgeon 30. As scrub nurse 225 guides sleeve members 140*a* and 140*b* onto arms 135 of surgeon 30, arms 135 of surgeon 30 will pass through arm openings 130*a* and 130*b* and be inserted into sleeve members 140*a* and 140*b*. Closure members 160 conform to the wrists of surgeon 30 for maintaining sleeve members 140*a* and 140*b* in a predetermined position on arms 135 of surgeon 30 and for providing a suitable seal thereat. Thereafter, scrub nurse 225 assists surgeon 30 in placing shoulder portions 120*a* and 120*b* upon shoulders 400*a* and 400*b*, respectively, of surgeon 30. Scrub nurse 225 also assists surgeon 30 in inserting his hands in sterile gloves according to a predetermined gloving procedure.

Referring to FIGS. 4, 5, 10 and 11, the surgeon 30 separates first segment 280 of first embodiment quick-release transfer card 260 from second segment 330 of first embodiment quick-release transfer card 260. Surgeon 30 then hands second segment 330 to scrub nurse 225 while retaining possession of first segment 280. As scrub nurse 225 receives second segment 330 in one hand 403, scrub nurse 225 simultaneously grasps shoulder flap tabs 168*a* and 168*b* in the other hand 405.

With reference to FIGS. 12, 13, 14 and 15, scrub nurse 225 holds both second segment 330 of quick-release transfer card 260 and shoulder flap tab 168, as described hereinabove, as surgeon 30 rotates substantially on a vertical axis 407 through an angle theta "Ø" of approximately 360 degrees counterclockwise. As surgeon 30 rotates counterclockwise 360 degrees, scrub nurse 225 who is holding both second segment 330 and shoulder flap tab 168, extends shoulder flap 210 over first shoulder portion 120*a* of panel 20. Previously mentioned curvilinear portion 100 has a contour that conforms to the juncture of first shoulder portion 120*a* and arm 135 of surgeon 30 to facilitate unimpeded extension of shoulder flap 210 over first shoulder portion 120*a*. Surgeon 30 then engages male hook shoulder flap tab 168 with female loop portion 165 that is attached to the front left of the surgical gown 10. In this manner, shoulder flap tab 168 is releasably secured to the front left of surgical gown 10, by means of the hook-and-loop engagement of male hook shoulder flap tab 118 with female loop portion 165. It should be appreciated that this configuration of surgical gown 10 allows shoulder flap 210 to snugly and partially surround the neck of the surgeon without assistance of the circulating nurse.

Referring to FIGS. 16, 17, 18 and 19, after surgeon 30 has rotated 360 degrees, second segment 330 of quick-release transfer card 260 being held by scrub nurse 225 is handed to surgeon 30, so that surgeon 30 can secure the lower extended part of first embodiment gown 10 that is defined by rear torso portion 180 of panel 20. Therefore, the lower extended part of gown 10 now covers the back of surgeon 30. This eliminates a need for the circulating nurse to tie strings in the back of the gown because there are no strings to be tied in the back of gown 10. Also, as previously mentioned, shoulder flap 210 is completely and sterilely secured about the neck of surgeon 30, thereby eliminating a need for the circulating nurse to tie or otherwise fasten gown 10 about the neck of surgeon 30. Surgeon 30 thereafter separates second end 250*b* of first waist tie string 230 and second end 270*b* of second waist tie string 240 from their respective segments 280 and 330 of the quick-release transfer card 260. Surgeon then ties waist tie string stings 230 and 240 together. At this point, the donning procedure is complete and surgeon 30 may proceed with surgery.

Figure 20:
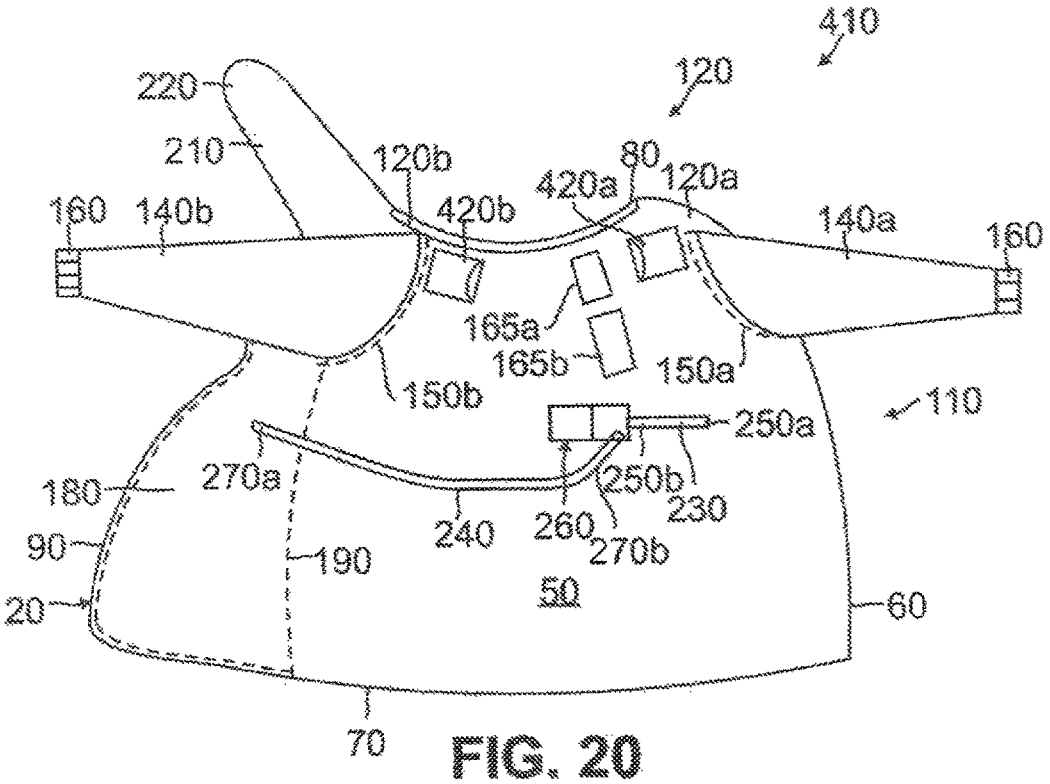
FIG. 20 is a view in elevation of a second embodiment surgical gown including a plurality of pockets for receiving hands of the scrub nurse in order to assist the surgeon in donning the second embodiment surgical gown.
Figure 21:
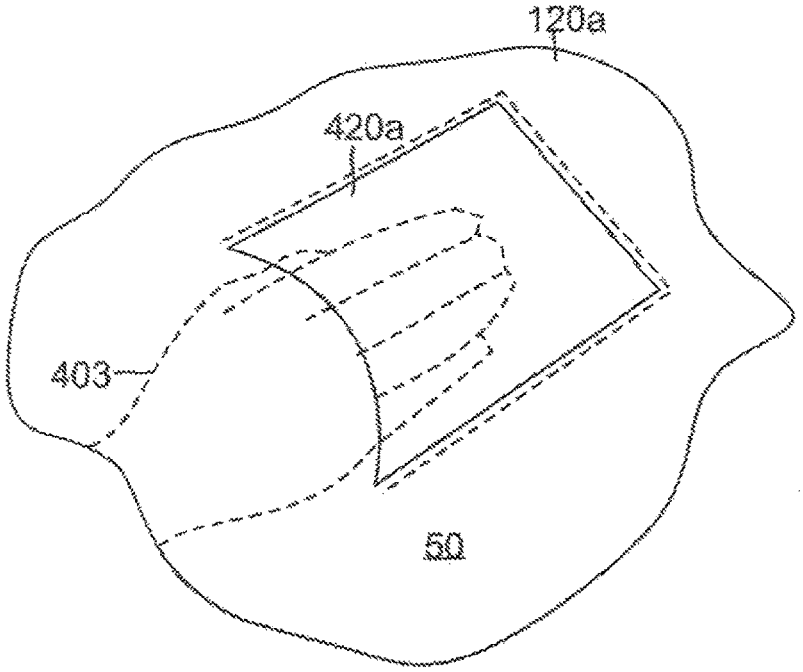
FIG. 21 is a fragmentary view in perspective of a hand belonging to the scrub nurse being received into one of the plurality of pockets.
Figure 22:
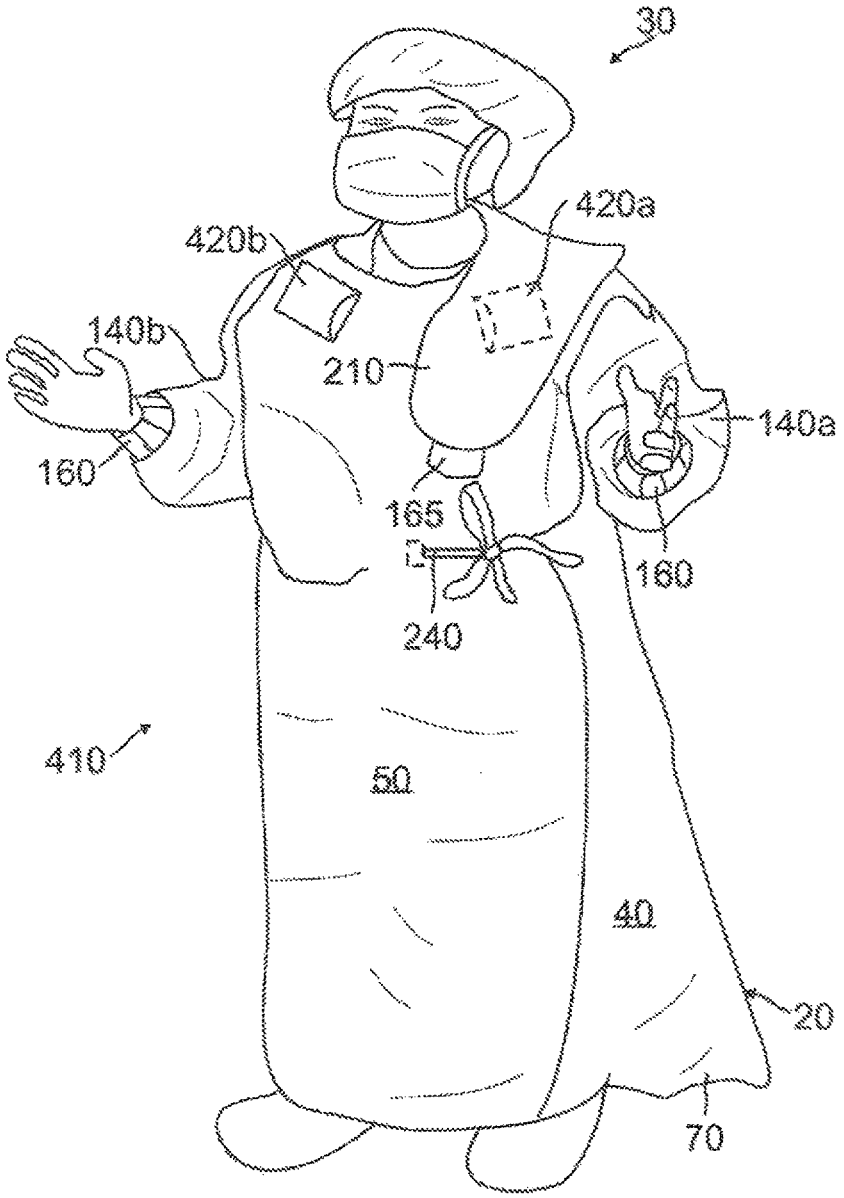
FIG. 22 is a view in perspective of the surgeon having donned the second embodiment surgical gown.

With reference to FIGS. 20, 21 and 22, there is shown a second embodiment surgical gown, generally referred to as 410, for providing an effective barrier to protect a surgery patient and operating room personnel from transfer of microorganisms, body fluids and particulates that might otherwise cause infections. Second embodiment surgical gown 410 is substantially similar to first embodiment surgical gown 10, except a plurality of pockets, such as first pocket 420*a* and second pocket 420*b*, are provided for allowing scrub nurse 225 to assist surgeon 30 in donning second embodiment surgical gown 410. More specifically, scrub nurse 225 faces surgeon 30 and inserts her hands 403 and 405 into corresponding pockets 420*a* and 420*b*. Scrub nurse 225 then uses hands 403 and 405 to maneuver second embodiment surgical gown 410 so as drape second embodiment surgical gown 410 onto surgeon 30. At that point, gowning of surgeon 30 proceeds as in the case of first embodiment surgical gown 10.

In FIGS. 23, 24, 25, 26 and 27, various means are shown for releasably fastening shoulder flap 210 to front torso portion 110 of panel 20. For example, previously mentioned first embodiment fastener arrangement 166 comprising male hook shoulder flap tabs 168*a* and 168*b* can be caused to engage female loop members 165*a* and 165*b* such as being movable or rotatable in direction of an arrow 425. In this regard, first embodiment fastener arrangement 166 may be a commercially available VELCRO® brand fastener.

Alternatively, a second embodiment fastener arrangement, generally referred to as 430, may be used to releasably fasten shoulder flap 210 to front torso portion 110 of panel 20. In this case, second embodiment fastener arrangement 430 comprises a removable first adhesive layer 440*a* affixed to front torso portion 110 of panel 20. First adhesive layer 440*a* is capable of releasably adhering to a pressure sensitive removable second adhesive layer 440*b* that is, in turn, affixed to shoulder flap 210. The adhesives are removable in the sense that the adhesives form a temporary bond between shoulder flap 210 and front torso portion 110.

As another alternative, a third embodiment fastener arrangement, generally referred to as 450, may be used to releasably fasten shoulder flap 210 to front torso portion 110 of panel 20. In this case, third embodiment fastener arrangement 450 comprises a base 460 affixed to front torso portion 110 of panel 20. Base 460 defines a counter bore 470 sized to matingly receive, by means of a press-fit, a post 480 outwardly projecting from a plate 490. Post 480 is held within counter bore 470 by means of the press-fit until manually pried from counter bore 470.

As yet another alternative, a fourth embodiment fastener arrangement, generally referred to as 500, may be used to releasably fasten shoulder flap 210 to front torso, portion 110 of panel 20. In this case, fourth embodiment fastener arrangement 500 comprises a button 510 affixed to front torso portion 110 of panel 20. A button hole 520 that is formed in plate 490 releasably receives button 510.

In another alternative embodiment, a fifth embodiment fastener arrangement, generally referred to as 530, may be used to releasably fasten shoulder flap 210 to front torso portion 110 of panel 20. In this case, fifth embodiment fastener arrangement 530 comprises a clamp 540, such as a C-clamp. A hole 550 is provided in plate 490 for releasably accepting attachment of clamp 540 to plate 490. Clamp 540 may be a commercially available BLACK DIAMOND 210075 OVAL carabiner clamp which may be available from REI, Incorporated located in Summer, Wash., U.S.A.

With reference to FIGS. 28, 29, 30, 31, 32 and 33, there is shown a second embodiment surgical gown, generally referred to as 560. Second embodiment surgical gown 560 allows surgeon 30 to don second embodiment surgical gown 560 without assistance either of the circulating nurse or scrub nurse 225. In other words, surgeon 30 may self-don second embodiment surgical gown 560. To achieve this result, an upright structure, stand or pole 570 has a plurality of supports, such as two spaced-apart supports connected to pole 570. An uppermost support 580 is adapted to grip or otherwise secure shoulder flap 210 to pole 570. A lowermost support 590 is adapted to grip or otherwise secure to pole 570 second segment 330 of the broken quick-release transfer card 260. In this manner, free end 270*b* of second waist tie string 240 is releasably attached to pole 570. After surgeon 30 secures shoulder flap 210 to uppermost support 580 and second segment 330 of quick-release transfer card 260 to lowermost support 590, the surgeon rotates 360 degrees counterclockwise as represented by angle theta "Ø". As the surgeon rotates 360 degrees counterclockwise, he holds first segment 280 of the quick-release transfer card 260 to which free end 250*b* of first waist tie string 230 is releasably attached. After the surgeon completes the 360 degree rotation, he retrieves the portion of the shoulder flap held by uppermost support 580 and attaches shoulder flap 580 to the front of second embodiment surgical gown 560, such as by hook-and-loop fasteners. The surgeon then retrieves second segment 330 of the quick-release transfer card 260 held by lowermost support 590. Next, the surgeon releases the two free ends 250*b* and 270*b* of waist tie strings 230 and 240 from their respective segments 280 and 330 of quick-release transfer card 260 and proceeds to tie waist tie strings 230 and 240 together. The donning procedure is complete, once waist tie strings 230 and 240 are tied together.

Illustrative Methods

An illustrative method associated with an exemplary embodiment for manufacturing surgical gowns will now be described.

Figure 34:
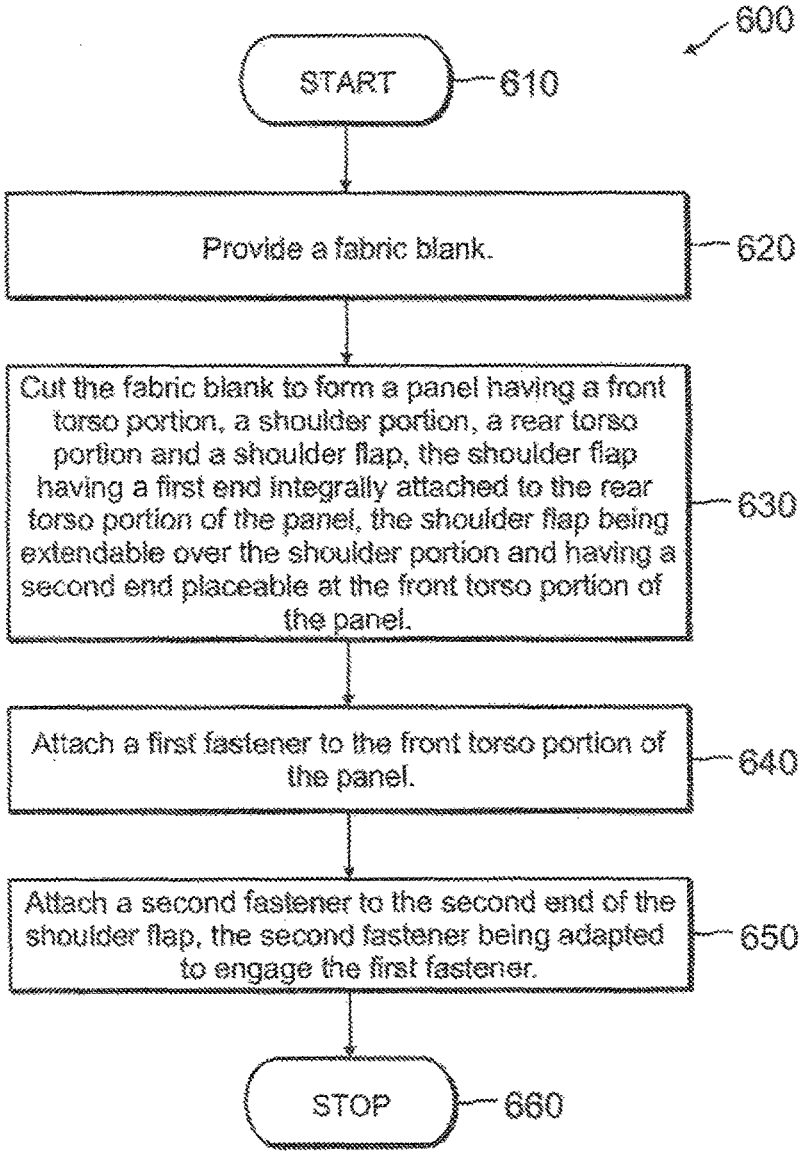
FIG. 34 is a flowchart showing an illustrative method of manufacturing a surgical gown according to the invention.

Referring to FIG. 34, an illustrative method 600 that is provided for manufacturing a surgical gown starts at a block 610. At a block 620, a fabric blank is provided. At a block 630, the fabric blank is cut to form a panel having a front torso portion, a shoulder portion, a rear torso portion and a shoulder flap, the shoulder flap having a first end integrally attached to the rear torso portion of the panel, the shoulder flap being extendable over the shoulder portion and having a second end placeable at the front torso portion of the panel. At a block 640, a first fastener is attached to the front torso portion of the panel. At a block 650, a second fastener is attached to the second end of the shoulder flap, the second fastener being adapted to engage the first fastener. The method stops at a block 660.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited, examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Applicants reserve the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicants reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in haec verba or recited verbatim in the written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. The patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. For example, rather than tying the waist tie strings, it should be appreciated that pressure sensitive removable adhesives, snaps, buttons or magnets may be used to releasably secure the waist tie strings together. As another example, rather than a flowable sealant to seal seams, an adhesive tape may be adhered to the interior of the gown to cover and seal the seams. Accordingly, the description hereinabove is not intended to limit the invention, except as indicated in the following claims.

Therefore, provided herein are a surgical gown and a method of manufacturing the surgical gown.

What is claimed is:

1. A surgical gown, consisting of:

a front panel defined by a top edge, a bottom edge, and a pair of opposing arcuate shaped side edges wherein one of said pair of opposing arcuate shaped side edges is a free side edge and the other one of said pair of opposing arcuate shaped side edges is an attached side edge;

a rear panel defined by another top edge contiguous with said top edge, another bottom edge contiguous with said bottom edge, a free curvilinear side edge and an attached curvilinear side edge, wherein said attached curvilinear side edge is attached to the attached side edge of the other one of said pair of opposing arcuate shaped side edges to provide said rear panel with an upper draping portion and a lower draping portion, wherein said upper draping portion and said lower draping portion enable self-donning of the surgical gown;

wherein said front panel is provided with a pair of spaced apart openings providing access to a corresponding pair of sleeve members extending outwardly from a front surface area of said front panel;

wherein one of said pair of openings is disposed adjacent to a juncture between said top edge of said front panel and said another top edge of said rear panel and another juncture between said top draping portion and said lower draping portion to provide a contour that enables the unimpeded extension of said top draping portion over a top portion of said front panel extending down to a mid-area of said front panel wherein a distal end portion of said top draping portion is removably secured to a quick-release transfer card to further enable self-donning of the surgical gown;

wherein said quick-release transfer card includes a first segment and a second segment, wherein one end of said first segment is releasably attached to a free end of a front panel tie string and an opposite end of the front panel tie string is fixed to said front panel and a free end of a rear panel tie string is fixed at an opposite end of the rear panel tie string to said lower draping portion of the rear panel;

wherein one end of said second segment is releasably secured to said distal end portion of said top draping portion and wherein another end of said second segment is releasably secured to another end of said first segment to enable said quick-release transfer card to be broken apart to free said first segment from said second segment to further enable the self-donning of the surgical gown;

wherein upon the separation of the first segment from the second segment, said lower draping portion is movable from an initial donning position to a final donning position completely closing said front panel as said free curvilinear side edge of said rear panel is extended over said free arcuate shaped side edge of said front panel and further extended to said mid-area of said front panel wherein the free end of said front panel tie string when released from said first segment and the free end of said lower draping portion of said rear panel when released from said first segment are freed to be tied together to secure said front panel to said lower draping portion of said rear panel; and wherein upon the separation of said first segment from said second segment, said upper draping portion is moveable from one side of said mid-area of said front panel, and extended unimpededly over an opposite side of said top portion of said front panel extending down to an opposite side of the mid-area of said front panel wherein said distal end of said upper draping portion when releasably separated from said second segment is free to be attached to said front panel by a plurality of attachments partially disposed on said front panel and partially disposed on said distal end portion of said upper draping portion.

2. The surgical gown, according to claim 1, wherein the front panel further comprises a liner attached to an interior surface area of the front panel.

3. The surgical gown, according to claim 1, wherein the front panel further comprises a pocket attached to the mid area of said front panel to help with the moving the front panel into said first draping position.

4. The surgical gown, according to claim 1, wherein said plurality of attachments partially disposed on said front panel is a hook and loop fastener.

5. The surgical gown, according to claim 4, wherein said hook and loop fastener is either a plurality of female loop members or a plurality of male hook members.

6. The surgical gown, according to claim 5, wherein said plurality of attachments partially disposed on said distal end portion of said upper draping portion is another hook and loop fastener.

7. The surgical gown, according to claim 5, wherein said another hook and loop fastener is either a plurality of male hook members or a plurality of female loop members.

8. The surgical gown according to claim 1, wherein said front panel and said rear panel are sewn together along their respective attached edges.

9. The surgical gown according to claim 1, wherein said front panel and said rear panel are sealed along their respective attached edges.

10. The surgical gown according to claim 1, wherein said upper draping portion and said lower draping portion are integrally attached to one another to form said rear panel.

11. The surgical gown according to claim 1, wherein said upper draping portion and said lower draping portion are sewn together to form said rear panel.

12. A surgical gown, comprising:

a panel including a first draping portion and a second draping portion, said first draping portion and said second draping portion cooperate with a plurality of self-donning articles partially disposed on an outer surface area of said first draping portion and partially disposed on an outer surface area of said second draping portion to completely close the surgical gown thereby providing an effective barrier from the transfer of microorganisms, body fluids and particulates to a wearer draped with the surgical gown, wherein said plurality of self-donning articles includes:

a breakable quick-release transfer card coupled between said first draping portion and said second draping portion, said breakable quick-release transfer card having a first segment with a first upper surface and a first under surface, and a second segment having a first upper surface and a first under surface;

wherein the first upper surface of said first segment is temporarily secured to the first under surface of said second segment by a pressure sensitive adhesive layer to enable a breaking away of said first segment from said second segment during the self-donning process; and wherein the first under surface of said second segment is further provided with a fastener adapted to releasably engage the upper wrapping section of said second draping portion for temporarily securing said second draping portion to said breakable quick-release transfer card while said first segment and said second segment are temporarily secured together and for releasably securing said the upper wrapping section of said second draping portion to a front panel fastener disposed on the mid-section area of said first draping portion when said first segment and said second segment are separated from one another to secure the second draping portion to the first draping portion in a closed wrap around donned configuration ending the self-donning process;

said first draping portion including a top edge, a bottom edge and a pair of opposing arcuate shaped side edges, wherein one individual arcuate shaped side edge is attached to a side edge of said second draping portion extending between said top edge and said bottom edge and wherein another individual arcuate shaped side edge is a free side edge extending between said top edge and said bottom edge;

said second draping portion including an upper wrapping section and a lower wrapping section, wherein an upper side edge portion of said upper wrapping section and an upper side edge portion of said first draping portion cooperate to provide a contour at an upper juncture therebetween to provide for the unimpeded extension of said upper wrapping section over an upper portion of said first draping portion extending down to a mid-section area of said first draping portion for securing said upper wrapping section to the mid-section area of said first draping portion during a self-donning process; and said lower wrapping section having sufficient length and width dimensions to provide for the unimpeded extension of said lower wrapping section over the free side edge of said first draping portion extending to said mid-section area of said first draping portion to be secured thereto during the self-donning process.

13. The surgical gown according to claim 12, wherein said first draping portion and said second draping portion are sewn together.

14. The surgical gown according to claim 12, wherein said first draping portion and said second draping portion are sealed where they are sewn together.

15. The surgical gown according to claim 12, wherein said upper wrapping section and said lower wrapping section are integrally attached to one another.

16. The surgical gown according to claim 12, wherein said upper wrapping section and said lower wrapping section are sewn together.

17. A surgical gown, comprising:

a front panel attached to a rear panel for helping to establish forwardly facing and rearwardly facing sterile barriers within a sterile operating environment; and a plurality of self-donning articles to help enable self-donning of the surgical gown, wherein said plurality of self-donning articles is partially disposed on and releasably secured to a mid-area of said front panel and partially disposed on and releasably secured to an upper portion of said rear panel, wherein the plurality of self-donning articles further comprises:

a breakable quick-release transfer card for helping with self-donning of the surgical gown, said breakable quick-release transfer card includes a first segment with a first upper surface and a first under surface, and a second segment having a first upper surface and a first under surface;

wherein the first upper surface of said first segment is temporarily secured to the first under surface of said second segment by a pressure sensitive adhesive layer to enable a breaking away of said first segment from said second segment for the surgical gown self-donning purpose; wherein the first under surface of said second segment is further provided with a fastener adapted to releasably engage the upper portion of the rear panel for temporarily securing said rear panel to said breakable quick-release transfer card while said first segment and said second segment are temporarily secured together and for releasably securing said the upper portion of the rear panel to a front panel fastener on the mid-area of said front panel when said first segment and said second segment are separated from one another to secure the rear panel onto the front panel in a closed wrap around donned configuration;

a pair of waist tie strings for securing said rear panel to the front panel;

wherein said pair of waist tie strings include:

a first waist tie string having a proximal end permanently affixed to the mid-area of said front panel and a free distal end releasably secured to the breakable quick-release transfer card; and a second waist tie string having a proximal end permanently affixed to said rear panel and a free distal end releasably secured to the breakable quick-release transfer card;

wherein said first waist tie string and second waist tie string are tied together when separated from said breakable quick-release transfer card for helping to secure said front panel to the rear panel in said closed wrap around donned configuration.

18. The surgical gown, according to claim 17, further comprising:

a liner attached to an inner surface area of said front panel for providing gown penetration protection to a wearer of the surgical gown.

19. The surgical gown, according to claim 17, further comprising:

a pocket attached to an outer surface area of said front panel for helping with donning of the surgical gown.

20. The surgical gown, according to claim 17, wherein the front panel fastener is a hook and loop fastener arrangement.

21. The surgical gown, according to claim 20, wherein the hook and loop fastener arrangement includes a female loop member or a male hook member.

22. The surgical gown according to claim 17, wherein said front panel and said rear panel are sewn together.

23. The surgical gown according to claim 17, wherein said front panel and said rear panel are sealed where they are sewn together.

24. The surgical gown according to claim 17, wherein said upper portion of said rear panel is integrally attached to a lower draping portion of said rear panel.

25. The surgical gown according to claim 17, wherein said upper portion is sewn to a lower draping portion of said rear panel.

26. A surgical gown for use in a sterile operating environment, comprising:

a front panel attached to a wrapping panel; and a plurality of self-donning articles to help enable self-donning of the surgical gown, wherein said plurality of self-donning articles is partially disposed on and releasably secured to a mid-area of said front panel and partially disposed on and releasably secured to an upper portion of said wrapping panel;

wherein the plurality of self-donning articles includes:

a breakable quick-release transfer card for helping with self-donning of the surgical gown, said breakable quick-release transfer card having a first segment with a first upper surface and a first under surface;

said breakable quick-release transfer card further having a second segment with a first upper surface and a first under surface, wherein the first upper surface of said first segment is temporarily secured to the first under surface of said second segment by a pressure sensitive adhesive layer to enable a breaking away of said first segment from said second segment;

wherein the first under surface of said second segment is further provided with a fastener adapted to releasably engage the upper portion of said wrapping panel for temporarily securing the upper portion of said wrapping panel to said breakable quick-release transfer card while said first segment and said second segment are temporarily secured together and for releasably securing said the upper portion of said wrapping panel to a front panel fastener on the mid-area of said front panel when said first segment and said second segment are separated from one another to secure the upper portion of said wrapping panel onto the front panel in a closed wrap around donned configuration;

a pair of waist tie strings for securing said wrapping panel to the front panel;

wherein said pair of waist tie strings includes:

a first waist tie string having a proximal end permanently affixed to the mid-area of said front panel and a free distal end releasably secured to the breakable quick-release transfer card; and a second waist tie string having a proximal end permanently affixed to said wrapping panel and a free distal end releasably secured to the breakable quick-release transfer card;

wherein said first waist tie string and second waist tie string are tied together when separated from said breakable quick-release transfer card for helping to secure said front panel to a lower portion of said wrapping panel in said closed wrap around donned configuration.

27. The surgical gown, according to claim 26, wherein the front panel further comprises a liner attached to an interior surface area of the front panel.

28. The surgical gown, according to claim 26, wherein the front panel further comprises a pocket attached to the mid area of said front panel and adapted for moving the front panel into a donning position.

29. The surgical gown, according to claim 26, wherein the front panel fastener further comprises a hook and loop fastener arrangement.

30. The surgical gown, according to claim 29, wherein the hook and loop fastener arrangement further comprises a female loop member.

31. The surgical gown, according to claim 30, wherein the wrapping panel further comprises a male loop member secured to an underside of the wrapping panel thereof to secure said wrapping panel to said hook and loop fastener arrangement.

32. The surgical gown according to claim 26, wherein said front panel includes a free side edge and an attached side edge, and wherein said wrapping panel includes a free side edge and an attached side edge; and wherein said front panel and said wrapping panel are sewn together at their respective attached edges.

33. The surgical gown according to claim 26, wherein said front panel and said wrapping panel are sealed where they are sewn together.

* * * * *